US005781882A

United States Patent [19]

Davis et al.

[11] Patent Number: 5,781,882

[45] Date of Patent: Jul. 14, 1998

[54] VERY LOW BIT RATE VOICE MESSAGING SYSTEM USING ASYMMETRIC VOICE COMPRESSION PROCESSING

[75] Inventors: Walter Lee Davis, Parkland; Jian-Cheng Huang, Lake Worth; Leon Jasinski, Fort Lauderdale, all of Fla.

[73] Assignee: Motorola, Inc., Schaumburg, Ill.

[21] Appl. No.: 528,455

[22] Filed: Sep. 14, 1995

[51] Int. Cl.[6] ..... G10L 3/02

[52] U.S. Cl. ..... 704/221; 704/266

[58] Field of Search ..... 395/2.36, 2.37, 395/2.71, 2.73, 2.28, 2.32, 2.3, 2.09, 2.1, 2.91; 379/88, 56, 58, 57; 704/258, 266, 221, 500, 227

[56] References Cited

U.S. PATENT DOCUMENTS

| | | | |
|---|---|---|---|
| 4,479,124 | 10/1984 | Rodriguez et al. | 340/825 |
| 4,612,414 | 9/1986 | Juang | 395/2.28 |
| 4,701,943 | 10/1987 | Davis et al. | 379/57 |
| 4,769,642 | 9/1988 | Davis et al. | 340/825.44 |
| 4,811,376 | 3/1989 | Davis et al. | 379/57 |
| 4,815,134 | 3/1989 | Picone et al. | 395/2.09 |
| 4,873,520 | 10/1989 | Fisch et al. | 340/825.44 |
| 4,885,577 | 12/1989 | Nelson | 340/825.44 |
| 5,305,332 | 4/1994 | Ozawa | 371/31 |
| 5,327,520 | 7/1994 | Chen | 395/2.28 |
| 5,371,853 | 12/1994 | Kao et al. | 395/2.32 |
| 5,495,555 | 2/1996 | Swaminathan | 395/2.16 |

OTHER PUBLICATIONS

Jayant and Noll, *Digital Coding of Waveforms—Principles and Applications to Speech and Video*, pp. 510–523 and pp. 546–563, Prentice-Hall, Inc., Englewood Cliffs, NJ 1984.

Gersho and Gray, *Vector Quantization and Signal Compression*, pp. 605–626, Kluwer Academic Publishers, Norwell, MA, 1992.

*Primary Examiner*—Allen R. MacDonald
*Assistant Examiner*—Richemond Dorvil
*Attorney, Agent, or Firm*—Philip P. Macnak

[57] ABSTRACT

An apparatus and method for processing a voice message to provide low bit rate speech transmission processes the voice message to generate speech parameters which are arranged into a two dimensional parameter matrix (502) including a sequence of parameter frames. The two dimensional parameter matrix (502) is transformed using a predetermined two dimensional matrix transformation function (414) to obtain a two dimensional transform matrix (506). Distance values representing distances between templates of a set of predetermined templates and the two dimensional transform matrix (506) are then derived. The distance values derived are identified by indexes identifying the templates of the set of predetermined templates. The distance values derived are compared, and an index corresponding to a template of the set of predetermined templates having a shortest distance is selected and then transmitted.

61 Claims, 16 Drawing Sheets

900

VERY LOW BIT RATE VOICE MESSAGING SYSTEM USING ASYMMETRIC VOICE COMPRESSION PROCESSING

FIELD OF THE INVENTION

This invention relates generally to communication systems, and more specifically to a compressed voice digital communication system providing very low data transmission rates providing asymmetric voice compression processing.

BACKGROUND OF THE INVENTION

Communications systems, such as paging systems, have had to in the past compromise the length of messages, number of users and convenience to the user in order to operate the system profitably. The number of users and the length of the messages were limited to avoid over crowding of the channel and to avoid long transmission time delays. The user's convenience is directly effected by the channel capacity, the number of users on the channel, system features and type of messaging. In a paging system, tone only pagers that simply alerted the user to call a predetermined telephone number offered the highest channel capacity but were some what inconvenient to the users. Conventional analog voice pagers allowed the user to receive a more detailed message, but severally limited the number of users on a given channel. Analog voice pagers, being real time devices, also had the disadvantage of not providing the user with a way of storing and repeating the message received. The introduction of digital pagers with numeric and alphanumeric displays and memories overcame many of the problems associated with the older pagers. These digital pagers improved the message handling capacity of the paging channel, and provide the user with a way of storing messages for later review.

Although the digital pagers with numeric and alpha numeric displays offered many advantages, some user's still preferred pagers with voice announcements. In an attempt to provide this service over a limited capacity digital channel, various digital voice compression techniques and synthesis techniques have been tried, each with their own level of success and limitation. Techniques such as voice synthesizers simply replaced the numeric or alphanumeric display with a computer generated voice, sounding not at all like the originator voice. Standard digital voice compression methods, used by two way radios also failed to provide the degree of compression required for use on a paging channel. Voice messages that are digitally encoded using the current state of the art would monopolize such a large portion of the channel capacity that they may render the system commercially unsuccessful.

Accordingly, what is needed for optimal utilization of a channel in a communication system, such as the paging channel in a paging system, is an apparatus that digitally encodes voice messages in such a way that the resulting data is very highly compressed and can easily be mixed with the normal data sent over the communication channel. In addition what is needed is a communication system that digitally encodes the voice message in such a way that processing in the communication receiving device, such as a pager, is minimized.

SUMMARY OF THE INVENTION

In accordance with a first embodiment of the present invention there is provided a method for processing a voice message to provide a low bit rate speech transmission. The method comprises the steps of: processing the voice message to generate speech parameters; arranging the speech parameters into a two dimensional parameter matrix which comprises a sequence of parameter frames; transforming the two dimensional parameter matrix using a predetermined two dimensional matrix transformation function to obtain a two dimensional transform matrix; deriving a set of distance values which represent distances between templates of a set of predetermined templates and the two dimensional transform matrix, the distance values which are derived being identified by indexes which identify the templates of the set of predetermined templates; comparing the set of distance values which are derived and selecting therefrom an index which corresponds to a template of the set of predetermined templates which has a shortest distance of the set of distance values derived; and transmitting the index which corresponds to the template of the set of predetermined templates which has the shortest distance selected. In accordance with a first aspect of the present invent, there is provided an asymmetric voice compression processor which processes a voice message to provide a low bit rate speech transmission. The asymmetric voice compression processor comprises an input speech processor, a signal processor and a transmitter. The input speech processor processes the voice message to generate digitized speech data. The signal processor is programmed to generate speech parameters from the digitized speech data; arrange the speech parameters into a two dimensional parameter matrix which comprises a sequence of parameter frames; transform the two dimensional parameter matrix using a predetermined two dimensional matrix transformation function to obtain a two dimensional transform matrix; derive distance values which represent distances between templates of a set of predetermined templates and the two dimensional transform matrix, the distance values identified by indexes correspond to the templates of the set of predetermined templates; and compare the distance values which are derived to select therefrom an index which corresponds to a template of the set of predetermined templates which has a shortest distance of the distance values derived. The transmitter transmits the index which corresponds to the template of the set of predetermined templates which has the shortest distance selected.

In accordance with a second embodiment of the present invention, there is provided a method for processing a low bit rate speech transmission to provide a voice message. The method comprises the steps of: receiving one or more indexes which correspond to one or more templates of a set of predetermined templates, generating an array of speech parameters from the one or more templates which correspond to the one or more indexes received, processing the array of speech parameters to generate decompressed digital speech data, and generating a voice message from the decompressed digital speech data.

In accordance with a second aspect of the present invention, there is provided a communication device which receives a low bit rate speech transmission to provide a voice message. The communication device comprises a receiver which receives one or more indexes which correspond to one or more templates of a set of predetermined templates, a signal processor which is programmed to generate an array of speech parameters from the one or more templates corresponding to the one or more indexes received, a speech synthesizer which processes the array of speech parameters and generates decompressed digital speech data, and a converter which generates the voice message from the decompressed digital speech data.

In accordance with a third embodiment of the present invention, there is provided a method for processing a voice message to provide a low bit rate speech transmission. The method comprises the steps of receiving an entire voice message, processing the entire voice message to derive therefrom a sequence of indexes which identify a sequence of predetermined templates representing a speech parameter matrix, and transmitting the sequence of indexes.

DESCRIPTION OF A PREFERRED EMBODIMENT

Figure 1:
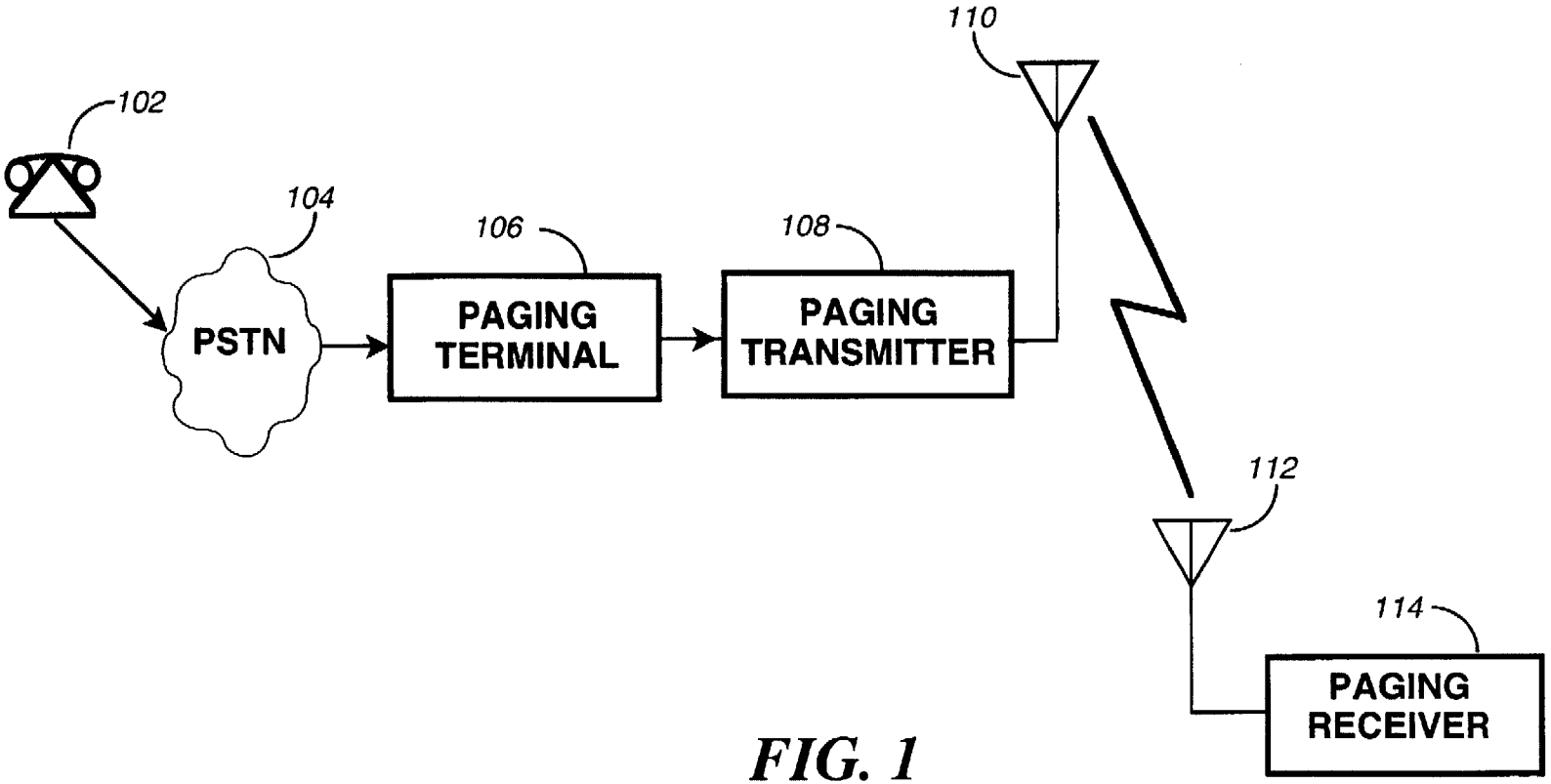
FIG. 1 is a block diagram of a communication system utilizing a digital voice compression process in accordance with the present invention.

FIG. 1 shows a block diagram of a communications system, such as a paging system, utilizing very low bit rate speech transmission using asymmetric voice compression processing in accordance with the present invention. The asymmetric voice compression processing of the present invention uses a 32-bit BCH code word to represent a very long segment of speech, typically 320 to 480 milliseconds as will be described below. Using conventional telephone techniques 32 bits would represent a 0.5 millisecond segment of speech. The digital voice compression process is adapted to the non-real time nature of paging and other non-real time communications systems which provide the time required to perform a highly computational intensive process on very long voice segments. In a non-real time communications there is sufficient time to receive an entire voice message and then process the message. Delay of two minutes can readily be tolerated in paging systems where delays of two seconds are unacceptable in real time communication systems. The asymmetric nature of the digital voice compression process minimizes the processing required to be performed in a portable communication device, such as a pager, making the process ideal for paging applications and other similar non-real time voice communications. The highly computational intensive portion of the digital voice compression process is performed in a fixed portion of the system and as a result little computation is required to be performed in the portable portion of the system as will be described below.

By way of example, a paging system will be utilized to describe the resent invention, although it will be appreciated that other non-real time communication systems will benefit from the present invention as well. A paging system is designed to provide service to a variety of users each requiring different services. Some of the users will require numeric messaging services, other users alpha-numeric messaging services, and still other users may require voice messaging services. In the paging system, the caller originates a page by communicating with a paging terminal 106 via a telephone 102 through the public switched telephone network (PSTN) 104. The paging terminal 106 prompts the caller for the recipient's identification, and a message to be sent. Upon receiving the required information, the paging terminal 106 returns a prompt indicating that the message has been received by the paging terminal 106. The paging terminal 106 encodes the message and places the encoded message in a transmission queue. At an appropriate time, the message is transmitted by the paging transmitter 108 using a transmitter 108 and a transmitting antenna 110. It will be appreciated that in a simulcast transmission system, a multiplicity of transmitters covering a different geographic areas can be utilized as well.

The signal transmitted from the transmitting antenna 110 is intercepted by a receiving antenna 112 and processed by a communications device 114, shown in FIG. 1 as a paging receiver. The person being paged is alerted and the message is displayed or annunciated depending on the type of messaging being employed.

Figure 2:
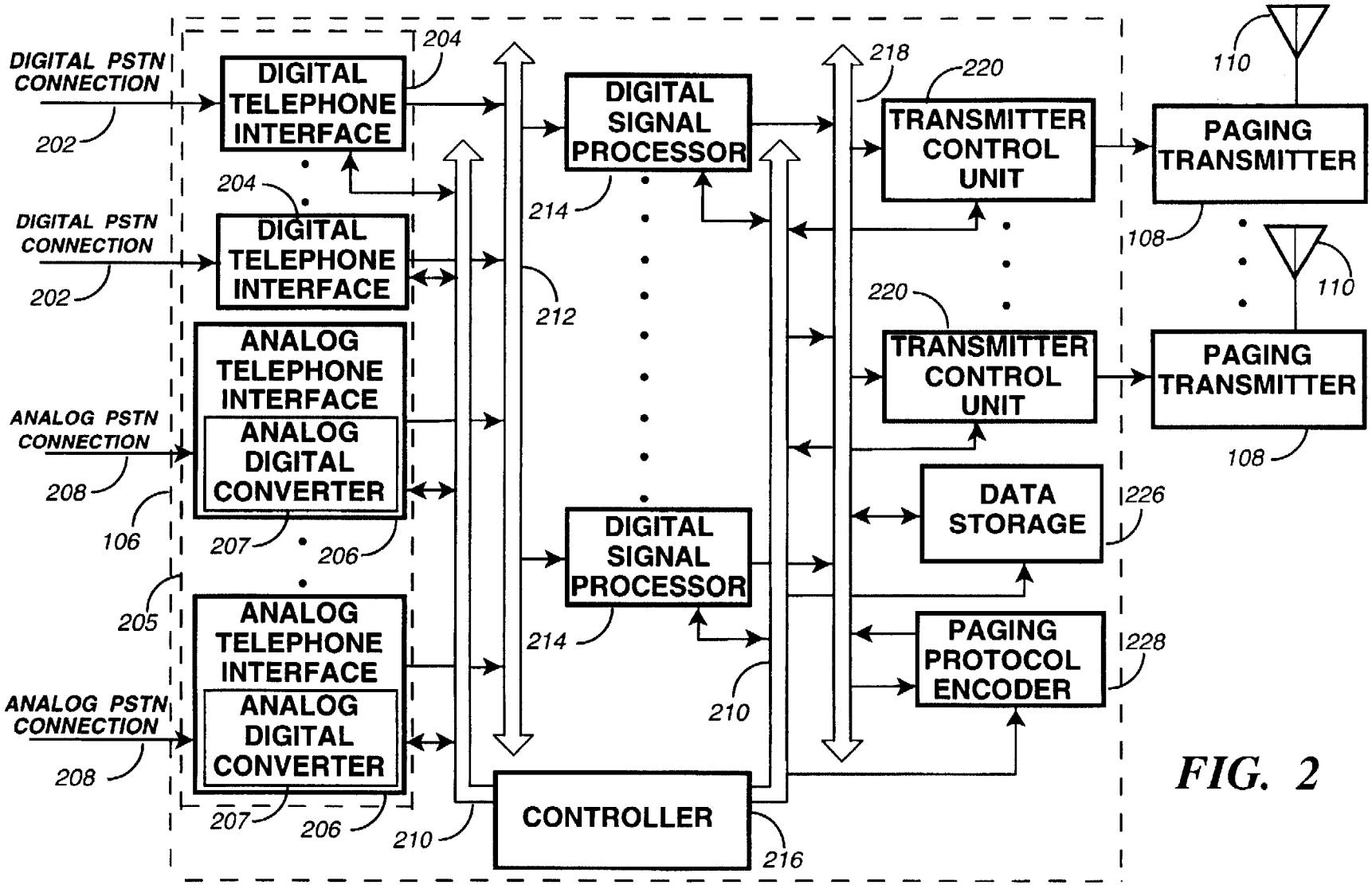
FIG. 2 is a electrical block diagram of a paging terminal and associated paging transmitters utilizing the digital voice compression process in accordance with the present invention.

An electrical block diagram of the paging terminal 106 and the paging transmitter 108 utilizing the digital voice compression process in accordance with the present invention is shown in FIG. 2. The paging terminal 106 shown in FIG. 2 is of a type that would be used to serve a large number of simultaneous users, such as in a commercial Radio Common Carrier (RCC) system. The paging terminal 106 utilizes a number of input devices, signal processing devices and output devices controlled by a controller 216. Communications between the controller 216 and the various devices that compose the paging terminal 106 are handled by a digital control buss 210. Communication of digitized voice and data is handled by an input time division multiplexed highway 212 and an output time division multiplexed highway 218. It will be appreciated that the digital control buss 210, input time division multiplexed highway 212 and output time division multiplexed highway 218 can be extended to provide for expansion of the paging terminal 106.

The input speech processor 205 provides the interface between the PSTN 104 and the paging terminal 106. The PSTN connections can be either a plurality of multi-call per line multiplexed digital connections shown in FIG. 2 as a digital PSTN connection 202 or plurality of single call per line analog PSTN connections 208.

Each digital PSTN connection 202 is serviced by a digital telephone interface 204. The digital telephone interface 204 provides the necessary signal conditioning, synchronization, de-multiplexing, signaling, supervision, and regulatory protection requirements for operation of the digital voice compression process in accordance with the present invention The digital telephone interface 204 can also provide temporary storage of the digitized voice frames to facilitate interchange of time slots and time slot alignment necessary to provide an access to the input time division multiplexed highway 212. As will be described below request for service and supervisory responses are controlled by a controller 216. Communications between the digital telephone interface 204 and the controller 216 passes over the digital control buss 210.

Each analog PSTN connection 208 is serviced by an analog telephone interface 206. The analog telephone interface 206 provides the necessary signal conditioning, signaling, supervision, analog to digital and digital to analog conversion, and regulatory protection requirements for operation of the digital voice compression process in accordance with the present invention. The frames of digitized voice messages from the analog to digital converter 207 are temporary stored in the analog telephone interface 206 to facilitate interchange of time slots and time slot alignment necessary to provide an access to the input time division multiplexed highway 212. As will be described below request for service and supervisory responses are controlled by a controller 216. Communications between the analog telephone interface 206 and the controller 216 passes over the digital control buss 210.

When an incoming call is detected, a request for service is sent from the analog telephone interface 206 or the digital telephone interface 204 to the controller 216. The controller 216 selects a digital signal processor 214 from a plurality of digital signal processors. The controller 216 couples the analog telephone interface 206 or the digital telephone interface 204 requesting service to the digital signal processor 214 selected via the input time division multiplexed highway 212.

The digital signal processor 214 can be programmed to perform all of the signal processing functions required to complete the paging process. Typical signal processing functions performed by the digital signal processor 214 include digital voice compression in accordance with the present invention, dual tone multi frequency (DTMF) decoding and generation, modem tone generation and decoding, and prerecorded voice prompt generation. The digital signal processor 214 can be programmed to perform one or more of the functions described above. In the case of a digital signal processor 214 that is programmed to perform more then one task, the controller 216 assigns the particular task needed to be performed at the time the digital signal processor 214 is selected, or in the case of a digital signal processor 214 that is programmed to perform only a single task, the controller 216 selects a digital signal processor 214 programmed to perform the particular function needed to complete the next step in the paging process. The operation of the digital signal processor 214 performing dual tone multi frequency (DTMF) decoding and generation, modem tone generation and decoding, and prerecorded voice prompt generation is well known to one of ordinary skill in the art. The operation of the digital signal processor 214 performing the function of an very low bit rate asymmetric voice compression processor is described in detail below.

The processing of a page request, in the case of a voice message, proceeds in the following manner. The digital signal processor 214 that is coupled to an analog telephone interface 206 or a digital telephone interface 204 then prompts the originator for a voice message. The digital signal processor 214 compresses the voice message received using a process described below. The compressed digital voice message generated by the compression process is coupled to a paging protocol encoder 228, via the output time division multiplexed highway 218, under the control of the controller 216. The paging protocol encoder 228 encodes the data into a suitable paging protocol. One such protocol which is described in detail below is the Post Office Committee Standard Advisory Group (POCSAG) protocol. It will be appreciated that other signaling protocols can be utilized as well. The controller 216 directs the paging protocol encoder 228 to store the encoded data in a data storage device 226 via the output time division multiplexed highway 218. At an appropriate time, the encoded data is downloaded into the transmitter control unit 220, under control of the controller 216, via the output time division multiplexed highway 218 and transmitted using the paging transmitter 108 and the transmitting antenna 110.

In the case of numeric messaging, the processing of a page request proceeds in a manner similar to the voice message page with the exception of the process performed by the digital signal processor 214. The digital signal processor 214 prompts the originator for a DTMF message. The digital signal processor 214 decodes the DTMF signal received and generates a digital message. The digital message generated by the digital signal processor 214 is handled in the same way as the digital voice message generated by the digital signal processor 214 in the voice messaging case.

The processing of an alpha-numeric page proceeds in a manner similar to the voice message with the exception of the process performed by the digital signal processor 214. The digital signal processor 214 is programmed to decode and generate modem tones. The digital signal processor 214 interfaces with the originator using one of the standard user interface protocols such as the Page entry terminal (PET) protocol. It will be appreciated that other communications protocols can be utilized as well. The digital message generated by the digital signal processor 214 is handled in the same way as the digital voice message generated by the digital signal processor 214 in the voice messaging case.

Figure 3:
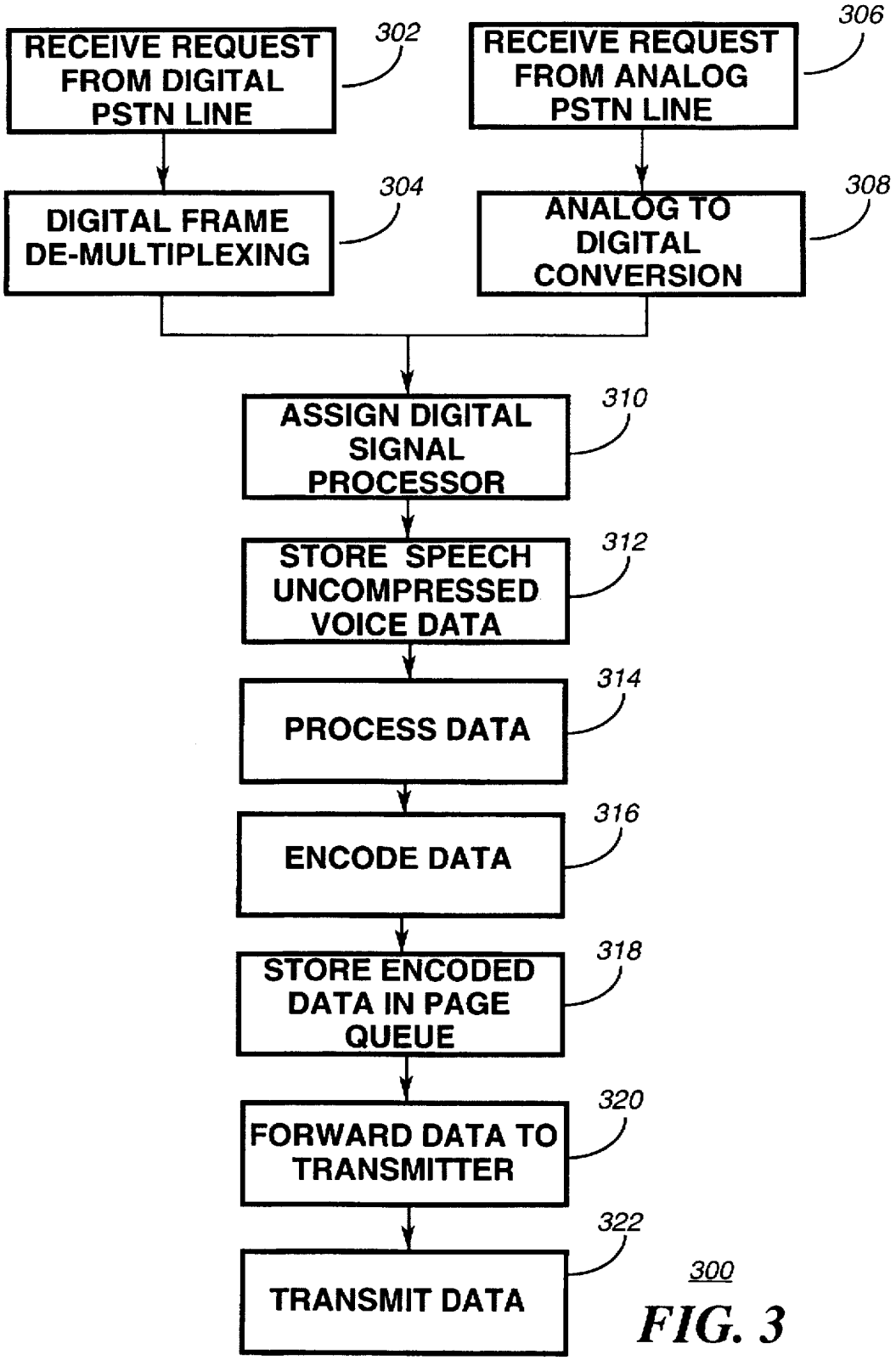
FIG. 3 is a flow chart showing the operation of the paging terminal of FIG. 2.

FIG. 3 is a flow chart which describes the operation of the paging terminal 106 shown in FIG. 2 when processing a voice message. There are shown two entry points into the flow chart 300. The first entry point is for a process associated with the digital PSTN connection 202 and the second entry point is for a process associated with the analog PSTN connection 208. In the case of the digital PSTN connection 202, the process starts with step 302, receiving a request over a digital PSTN line. Requests for service from the digital PSTN connection 202 are indicated by a bit pattern in the incoming data stream. The digital telephone interface 204 receives the request for service and communicates the request to the controller 216.

In step 304, information received from the digital channel requesting service is separated from the incoming data stream by digital frame de-multiplexing. The digital signal received from the digital PSTN connection 202 typically includes a plurality of digital channels multiplexed into an incoming data stream. The digital channels requesting service are de-multiplexed and the digitized speech data is then stored temporary to facilitate time slot alignment and multiplexing of the data onto the input time division multiplexed highway 212. A time slot for the digitized speech data on the input time division multiplexed highway 212 is assigned by the controller 216. Conversely, digitized speech data generated by the digital signal processor 214 for transmission to the digital PSTN connection 202 is formatted suitably for transmission and multiplexed into the outgoing data stream.

Similarly with the analog PSTN connection 208, the process starts with step 306 when a request from the analog PSTN line is received. On the analog PSTN connection 208, incoming calls are signaled by either low frequency AC signals or by DC signaling. The analog telephone interface 206 receives the request and communicates the request to the controller 216.

In step 308, the analog voice message is converted into a digital data stream. The analog signal received over its total duration is referred to as the analog voice message. The analog signal is sampled, generating voice message samples and digitized, generating digitized speech samples, by the analog to digital converter 207. The samples of the analog signal are referred to as voice message samples. The digitized voice samples are referred to as digitized speech data. The digitized speech data is multiplexed onto the input time division multiplexed highway 212 in a time slot assigned by the controller 216. Conversely any voice data on the input time division multiplexed highway 212 that originates from the digital signal processor 214 undergoes a digital to analog conversion before transmission to the analog PSTN connection 208.

As shown in FIG. 3, the processing path for the analog PSTN connection 208 and the digital PSTN connection 202 converge in step 310, when a digital signal processor is assigned to handle the incoming call. The controller 216 selects a digital signal processor 214 programmed to perform the digital voice compression process. The digital signal processor 214 assigned reads the data on the input time division multiplexed highway 212 in the previously assigned time slot.

The data read by the digital signal processor 214 is stored for processing, in step 312, as uncompressed speech data. The stored uncompressed speech data is processed in step 314, which will be described in detail below. The compressed voice data derived from the processing step 314 is encoded suitably for transmission over a paging channel, in step 316, as will be described below. In step 318, the encoded data is stored in a paging queue for later transmission. At the appropriate time the queued data is sent to the transmitter 108 at step 320 and transmitted, at step 322.

Figure 4:
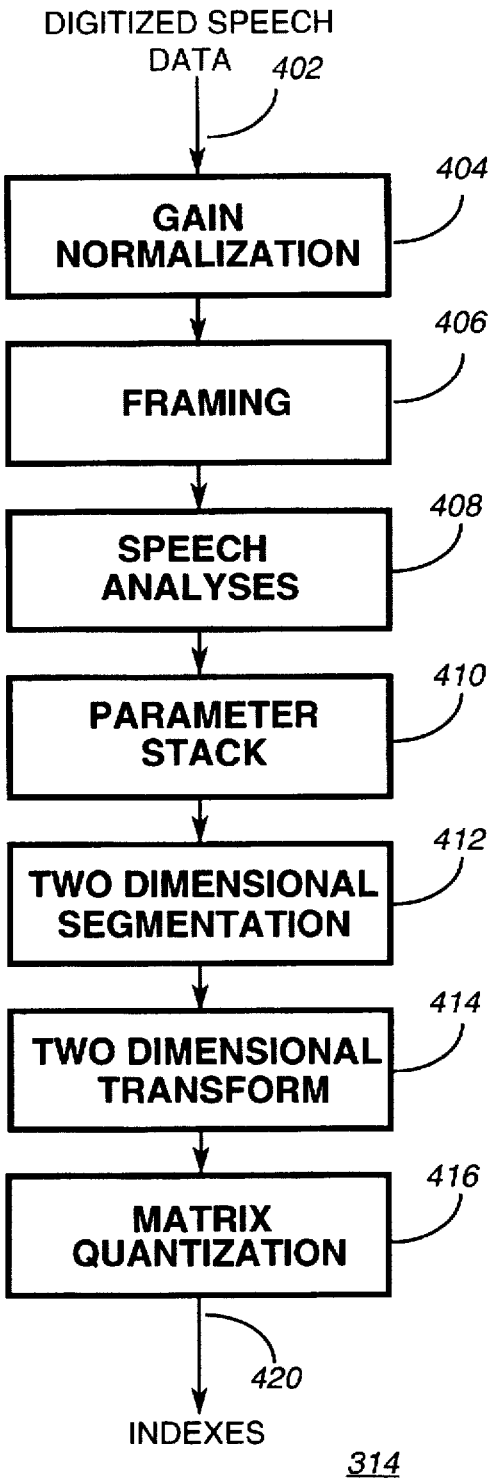
FIG. 4 is a flow chart showing the operation of a digital signal processor utilized in the paging terminal of FIG. 2.

The digital voice compression process of the present invention analyzes very long segments of speech data to obtain a very high degree of compression. FIG. 4 is a flow chart, detailing step 314 showing the operation of a digital signal processor utilized in the paging terminal of FIG. 2 while processing the digitized speech data. The digitized speech data 402 that was previously stored in the digital signal processor 214 as uncompressed voice data is analyzed at step 404 and the gain normalized. The amplitude of the digital speech message is adjusted on a syllabic basis to fully utilize the dynamic range of the system and improve the apparent signal to noise performance.

The normalized uncompressed speech data is grouped into a predetermined number of digitized speech samples which represent short duration segments of speech in step 406. The grouped speech samples represent short duration segments of speech is referred to herein as generating speech frames. Typically the groups contain twenty to thirty milliseconds of speech data. In step 408, a speech analysis is performed on the short duration segment of speech to generate speech parameters. The speech analysis process is typically a linear predictive code (LPC) process. The LPC process analyses the short duration segments of speech and calculates a number of parameters. There are many different speech analysis processes known. It will be apparent to one of ordinary skill in the art which speech analysis method will best meet the requirement of the system being designed. The digital voice compression process described herein preferably calculates thirteen parameters. The first three parameters quantize the total energy in the speech segment, a characteristic pitch value, and voicing information. The remaining ten parameters are referred to as spectral parameters and basically represent coefficients of a digital filter. In the preferred embodiment of the present invention each of the parameters is quantized using an eight bit digital word, although it will be appreciated the other quantization levels can be utilized as well.

In step 410 stacks the thirteen parameters calculated in step 408 are stacked into a two dimensional parameter matrix, or parameter stack which comprise a sequence of parameter frames. The thirteen parameters occupy one row of the matrix and are referred to herein as a speech parameter frame. In step 412, segments of the two dimensional speech data matrix are segmented into arrays of a predetermined number of parameter frames. Each array has typically eight to thirty two frames. It will become appreciated that the larger the array, the more intensive will the computational steps to be described below becomes. The current state of the digital signal processor art and the economics involved in the current paging market suggest an array of eight speech parameter frames is optimum for periods of dynamic speech. An array of sixteen or more speech parameter frames can be utilized for periods of less dynamic speech or quiet, however for purposes of description an array of eight speech parameter frames will be used. The arrays of speech parameter frames represent the very long voice segment referred to at the beginning of this specification. The very long voice segment contains by way of example eight frames, each containing twenty to thirty milliseconds of speech data or a 160 to 240 milliseconds segment of the analog voice message.

In step 414, a mathematical transform process, using a predetermined two dimensional matrix transformation function, is applied to each arrays of speech parameter frames. The transform process transforms the arrays of speech parameter frames into a two dimensional transformed array. The two dimensional transformed array is an array of parameters that are arranged in order of importance. The mathematical process utilized is preferably a two dimensional discrete cosine transform function, although it will be appreciated that other transforms that can be used to produce transformed arrays as well.

In step 416, the two dimensional transformed array is compared with a set of predetermined templates also referred to as voice templates. The set of predetermined templates is referred to herein as a code book. It will be shown below in a different embodiment of the present invention that the code book can contain two or more sets of templates. A typical code book for a paging application having one set of templates will have by way of example between five hundred twelve to one thousand twenty four templates. The matrix quantization function compares the two dimensional transformed array with each template in the code book and calculates a weighted distance between the code book and each template. The weighted distance is also referred to herein as a distance values. The index 420 of the template having a shortest distance to the two dimensional transformed array is selected to represent the very long segments of speech as will be described in further detail below. The distance values which are derived being identified by indexes identifying the templates of the set of predetermined templates.

The index 420 selected in step 416 is encoded into a predetermined signaling protocol for transmission over the paging channel. As will be described in further detail below, two indexes can be encoded into one code word of the protocol utilized in the present invention. Step 408 through 416 are repeated until all of the very long segments of speech have been quantized as an indexes.

Figure 5:
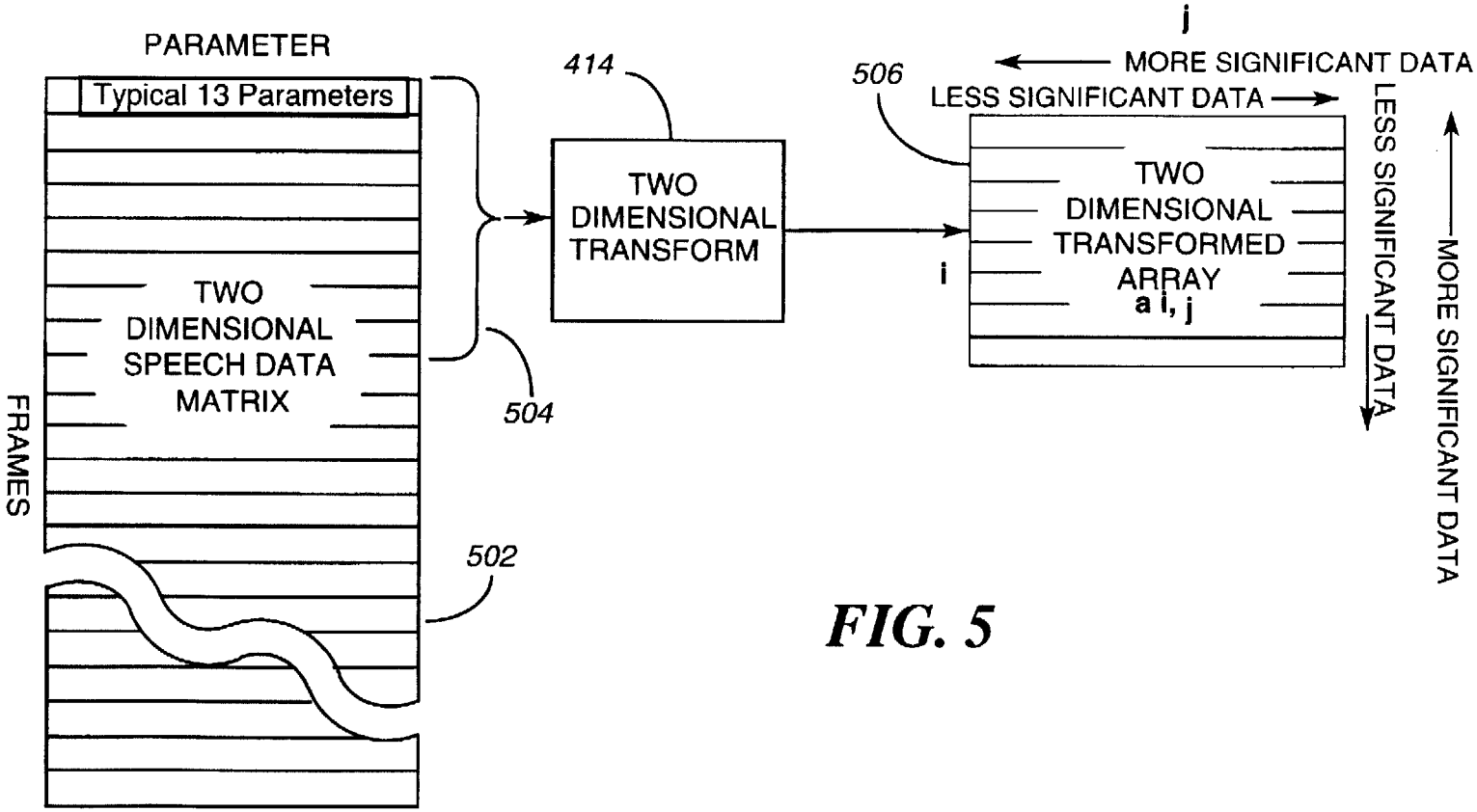
FIG. 5 is diagram illustrating a portion of the digital voice compression process utilized in the digital signal processor of FIG. 4.

FIG. 5 is diagram illustrating the digital voice compression process utilized in the digital signal processor of FIG. 4. The two dimensional speech data matrix discribed in step 410 is shown as the two dimensional parameter matrix 502. The two dimensional parameter matrix 502 has one row for each speech parameter frame generated in step 408. A bracket 504 encloses eight parameter frames forming an array of speech parameters. The predetermined two dimensional matrix transform function described in step 414 transforms the array of speech parameters into the two dimensional transformed array 506. The two dimensional transformed array 506 is labeled to illustrates how the transformed data is arranged in order of significance, with the most significant data stored in the upper left hand corner of the two dimensional transformed array 506 and the least significant data stored in the lower right hand corner of the two dimensional transformed array 506.

Figure 6:
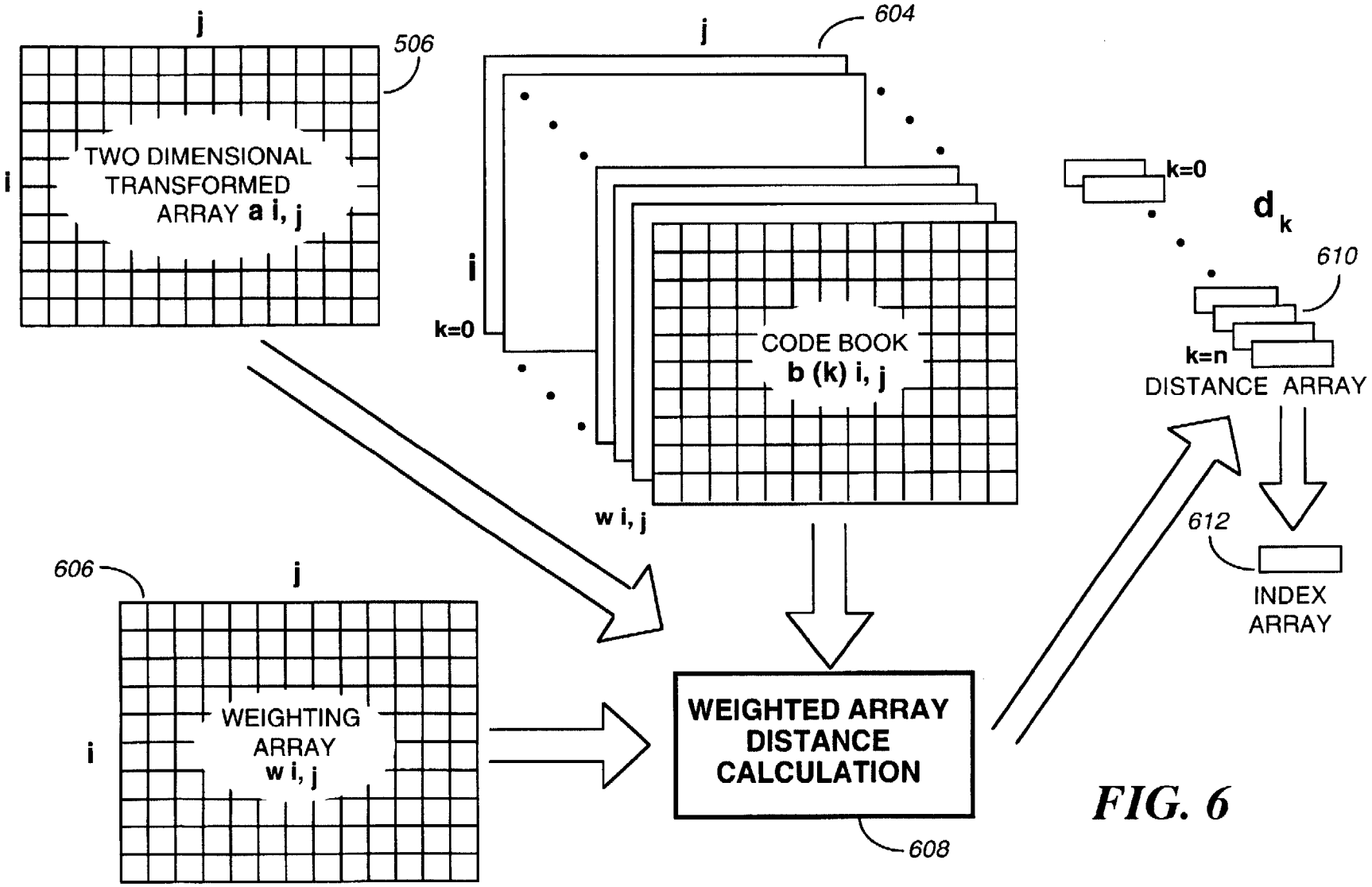
FIG. 6 is a diagram illustrating details of the digital voice compression process utilized in the digital signal processor of FIG. 4.

FIG. 6 is a diagram illustrating the processes performed for matrix quantization in step 416. The two dimensional transformed array 506 is illustrated having reference identifiers which are designated $a_{i,j}$ where the "a" designates the two dimensional transformed array, the subscript "i" designates the row of the array, and the subscript "j" designates the column of the array. A code book 604 is shown as an array "b" having a plurality of pages, "k", where the pages are numbered from k=0 to k=n. Each page of the code book 604 is a two dimensional array representing one voice template. The cells of the code book 604 are designated $b(k)_{i,j}$ where the "b(k)" designates the code book and the page, the subscript "i" designates the row of the array on page b(k), and the subscript "j" designates the column of the array on page b(k).

The distance calculation performed in step 416 is a process of subtracting the value in a cell in a template for each page b(k) in the code book 604 from a value in the corresponding cell in the two dimensional transformed array 506, squaring the result, multiplying the squared result by a weighting value in a corresponding cell of a predetermined weighting array 606, and repeating this process until the process has been performed on every cell in the three arrays. The distance between the two dimensional transformed array 506 and the template page b(k) is the sum of the weighted squared results of the previous calculations. This statistic distance is stored in a distance array 610, ($d_k$) at a location "k" corresponding to the page number b(k) or index of the template. The distance calculation described above can be shown as the following formula:

$$d_k = \sum_{i,j} w_{i,j}(a_{i,j} - b(k)_{i,j})^2$$

where:

$d_k$ equals the distance between the two dimensional transformed array 506 and the template page b(k), $w_{i,j}$ equals the weighting value in a cell i,j of a predetermined weighting array 606, $a_{i,j}$ equals the value in cell i,j of the two dimensional transformed array 506, and $b(k)_{i,j}$ equals the value in cell i,j of the code book 604.

After the distance between the two dimensional transformed array 506 and all of the templates for each page b(k) in the code book 604 have been calculated, the distance array 610, is searched for the cell having the shortest distance. The index of the cell having the shortest distance, corresponding to the page b(k) in the code book 604, is stored in the index array 612. In the present invention, the index is a ten bit code word representing one page of the one thousand twenty four pages or templates that compose the code book 604 b(k), and represents speech parameter array enclosed by bracket 504 which represents a very long voice segment as described above. By using a series of these indexes to point to duplicate templates stored in a code book in the communications device 114 the original voice message can be essentially replicated without intensive processing as will be described below.

The discrete cosine transform process is well known to one skilled in the art of digital signal processing and speech compression. The generation of the code books evolves a training process and this process is also well known one skilled in the art. The weighting array is generated by a empirical process involving a s series of trial weighting arrays and listening test.

Figure 7:
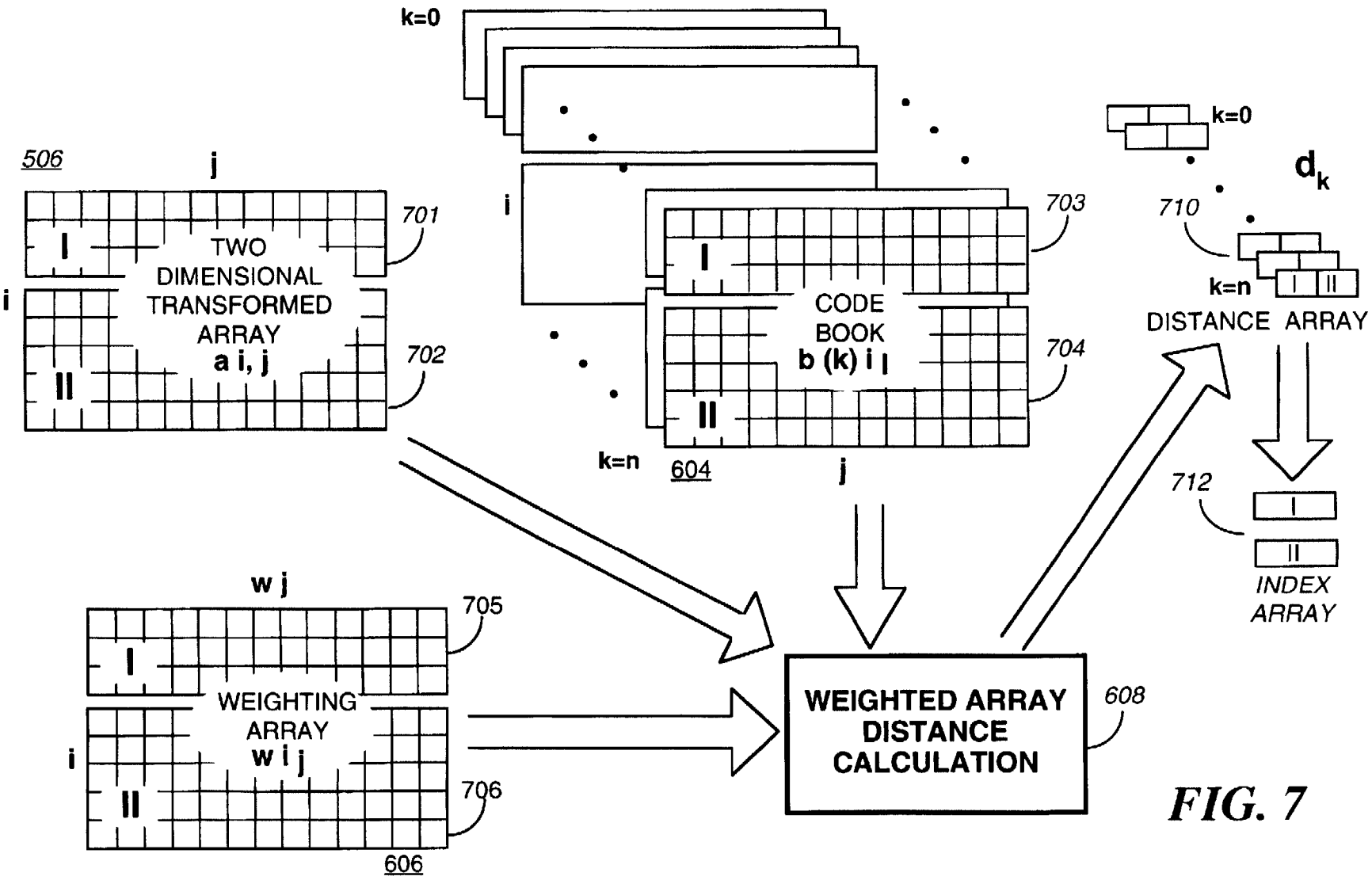
FIG. 7 is a diagram illustrating details of an alternate digital voice compression process utilized in the digital signal processor of FIG. 4.

An alternate embodiment of the present invention is shown in FIG. 7. Here the two dimensional transformed array 506 has been segmented into two segments of unequal size, segment I 701, and segment II 702, although it will be appreciated that under certain conditions the two segments can be of equal size as well. The smaller segment, segment I 701 represents the more significant data, and the larger segment, segment II 702 represents the less significant data. The code book 604 is segmented into two corresponding segments, identified as template set I 703 and template set II 704. In a similar manner, template set II 704, represents the less significant data and has fewer templates than template set I 703. The weighting array 602 is similarly segmented into segment I 705, and segment II 706. The distances between segment I 701 of the two dimensional transformed array 506 and all of the templates of template set I 703 of the code book 604 are calculated using the weighted array calculation 608 and the predetermined weighting array 606 segment I 705 as described above. The distances are stored in a first column of a distance array 710. In a like manner the distances between segment II 702 of the two dimensional transformed array 506 and all of the templates of template set II 704 of the code book 604 are calculated and stored in a second column of the distance array 710 as described above. When all of the distances have been calculated, column I of the distance array 710 is searched for the index representing the template of template set I 703 of the code book 604 having the shortest distance to segment I 701 of the two dimensional transformed array 506. Similarly column II of the distance array 710 is searched for the index representing the template of template of template set II 704 of the code book 604 having the shortest distance to segment II 702 of the two dimensional transformed array 506. The index from column I and column II form a code word representing the very long voice segment, as described above, and is stored in the index array 712. Segment II 702 of the two dimensional transformed array 506 is also referred to herein as a second set of predetermined templates. While the segmentation of the two dimensional transformed array 506 lengthens the code word, such segmentation also improves voice quality and reduces the computational effort. It will be appreciated that further segmentation will further improve voice quality and further reduce computational time at the expense of more data to be transmitted.

In another embodiment of the present invention, more than one code book 604 can be provided to better represent different speakers. For example, one code book can be used to represent a female speaker's voice and a second code book can be used to represent a male speaker's voice. It will be appreciated that additional code books reflecting language differentiation, such as Spanish, Japanese, etc. can be provided as well. When multiple code books are utilized, different PSTN telephone access numbers can be used to differentiate between different languages. Each unique PSTN access number is associated with group of PSTN connections and each group of PSTN connections corresponds to a particular language and corresponding code books. When unique PSTN access number are not used, the user can be prompted to provide information by enter a predetermined code, such as a DTMF digit, prior to entering a voice message, with each DTMF digit corresponding to a particular language and corresponding code books. Once the languages of the originator is identified by the PSTN line used or the DTMF digit received, the digital signal processor 214 selects a predetermined code book corresponding to the predetermined language from a set of predetermined code books corresponding to a set of predetermined languages which are stored in the digital signal processor 214. All voice prompts there after can be given in the language identified. The input speech processor 205 receives the information identifying the language and transfers the information to the appropriate digital signal processor 214. Alternatively the digital signal processor 214 can analyze the digital speech data to determine the language or dialect and selects an appropriate code book.

Code book identifiers are used to identify the code book that was used to compress the voice message. The code book identifiers are encoded along with the series of indexes and sent to the communications device 114 as will be described below. An alternate method of conveying the code book identity is to add a header, identifying the code book, to the message containing the index data.

In yet a further embodiment of the present invention, the number of speech parameters that are segmented into arrays of speech parameters in step 412 is not fixed as described above, but represents a variable number of parameter frames corresponding to the two dimensional parameter matrix. As previously stated above, an array of eight speech parameter frames is optimum for periods of dynamic speech and an array of sixteen or more speech parameter frames would be considered optimum for periods of less dynamic speech or silence. In this embodiment, an analysis of the two dimensional speech data matrix is performed and used to determine the number of frames that will compose the speech parameter array enclosed by bracket 504. Additional code books having suitable templates can be added for use during periods when an alternate number of frames is selected. The number of frames selected is encoded with the data that is transmitted to the communications device 114.

Figure 8:
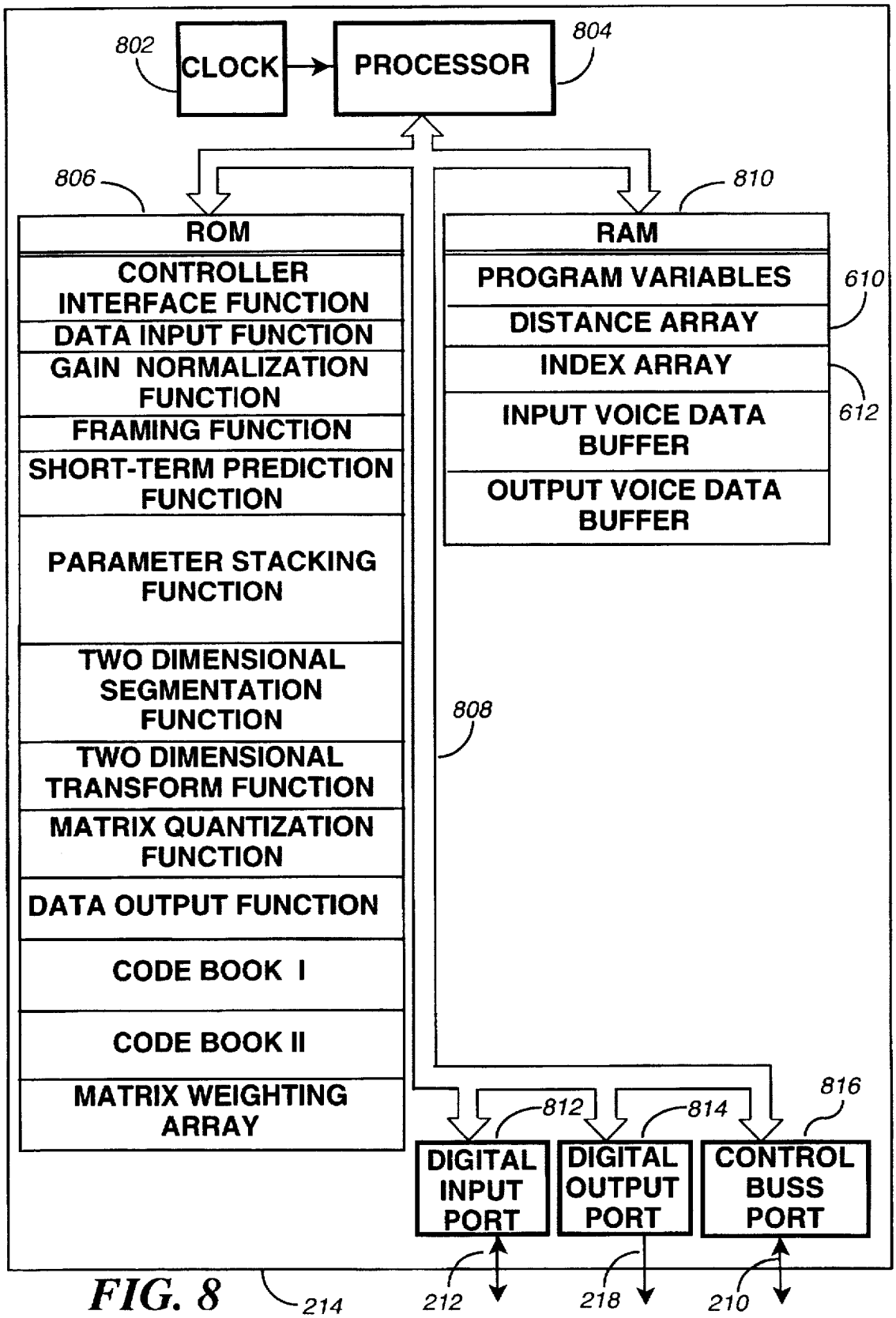
FIG. 8 is an electrical block diagram of the digital signal processor utilized in the paging terminal of FIG. 2.

FIG. 8 shows an electrical block diagram of the digital signal processor 214 utilized in the paging terminal 106 shown in FIG. 2. A processor 804, such as one of several standard commercial available digital signal processor ICs specifically designed to perform the computations associated with digital signal processing, is utilized. Digital signal processor ICs are available from several different manufactures, such as a DSP56100 manufactured by Motorola Inc. The processor 804 is coupled to a ROM 806, a RAM 810, a digital input port 812, a digital output port 814, and a control buss port 816, via the processor address and data buss 808. The ROM 806 stores the instructions used by the processor 804 to perform the signal processing function required for the type of messaging being used and control interface with the controller 216. The ROM 806 contains the instructions used to perform the functions associated with compressed voice messaging. The RAM 810 provides temporary storage of data and program variables, the distance array 610, the index array 612, the input voice data buffer, and the output voice data buffer. The digital input port 812 provides the interface between the processor 804 and the input time division multiplexed highway 212 under control of a data input function and a data output function. The digital output port provides an interface between processor 804 and the output time division multiplexed highway 218 under control of the data output function. The control buss port 816 provides an interface between the processor 804 and the digital control buss 210. A clock 802 generates a timing signal for the processor 804.

The ROM 806 contains by way of example the following: a controller interface function routine, a data input function routine, a gain normalization function routine, a framing function routine, a short term prediction function routine, a parameter stacking function routine, s two dimensional segmentation function routine, a two dimensional transform function routine, a matrix quantization function routine, a data output function routine, one or more code books, and the matrix weighting array as described above. RAM 810 provides temporary storage for the program variables, an input voice buffer, and an output voice buffer.

Figure 9:
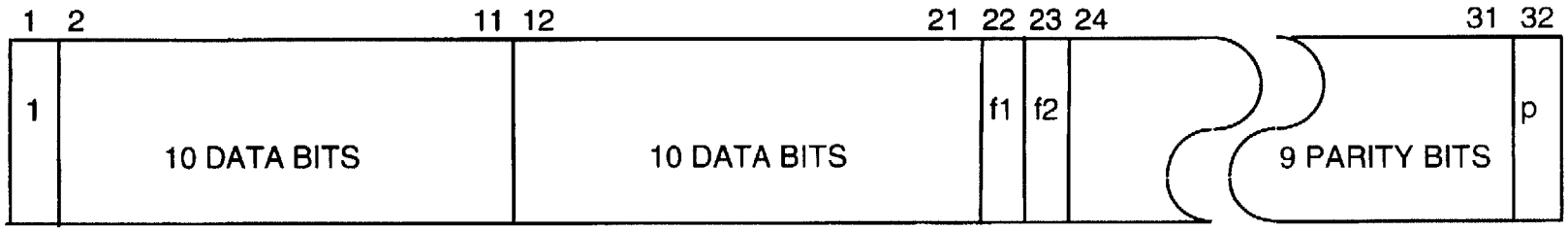
FIG. 9 is a diagram illustrating the compressed voice transmission format in accordance with the present invention.

FIG. 9 shows a typical POCSAG frame 900 utilized in the POCSAG signaling format which is adapted to encoded two ten bit indexes as described above. Table I, shown below, describes by way of example the allocation of each bit as utilized to convey digital compress voice in accordance with the present invention. Each POCSAG frame 900 has twenty two bits that are use to convey information, two, ten bit code words and two function bits. Each ten bit code word is capable of specifying one of up to one thousand twenty four different possible code book indexes. The first function bit, as shown in Table I below, is a segment size identifier used to define the size of the speech segment compressed. Function bit one indicates whether eight or sixteen frames of speech parameters were segmented into arrays of speech parameters in step 412. The second function bit is a code book identifier used to identify the code book used to compress the voice message. The remainder of the bits are parity bits used for error detection and correction as is well known in the art.

The advantages of the present invention can be shown by way of the following example. The total transmission time for the POCSAG frame 900 at 1200 bit per second (bps) is 26.7 milliseconds (ms) and at 2400 bps the time is reduced to 13.3 ms. In a specific embodiment of the present invention the POCSAG frame 900 includes two indexes of the index array 612 representing two 240 ms segments of speech. Thus in accordance with this specific embodiment of the present invention 480 ms of speech is transmitted in 13.3 ms, a time compression ratio of 40 to 1. A data compression ratio can also be calculated for this example.

Conventional telephone techniques encode speech at a rate of 64 kilobits per second. At this rate 480 ms of speech would requires 30,720 bits. The same 480 ms of speech can be transmitted using the present invention with 32 bits, yielding a data compression ratio of 960 to 1.

The resulting data is suitable for a very low bit rate speech transmission compared to the bit rate of conventional telephone techniques. It will be appreciated that the previously described parameters used in the compression process can be changed and will result in different compression ratios and different speech qualities.

TABLE I

| BIT | FUNCTION |
|---|---|
| 1 | Bit 1 = 0, Address Frame; Bit 1 = 1, Data Frame |
| 2~11 | First 10 Bit Data Word, Code Book Index |
| 12~21 | Second 10 Bit Data Word, Code Book Index |
| 22 | Function Bit = 0, 8 Voice Frames Per Array |
| | Function Bit = 1, 16 Voice Frames Per Array |
| 23 | Function Bit = 0, Code Book One |
| | Function Bit = 1, Code Book Two |
| 24~31 | 9 Bit Parity Word |
| 32 | Frame Parity Bit |

Figure 10:
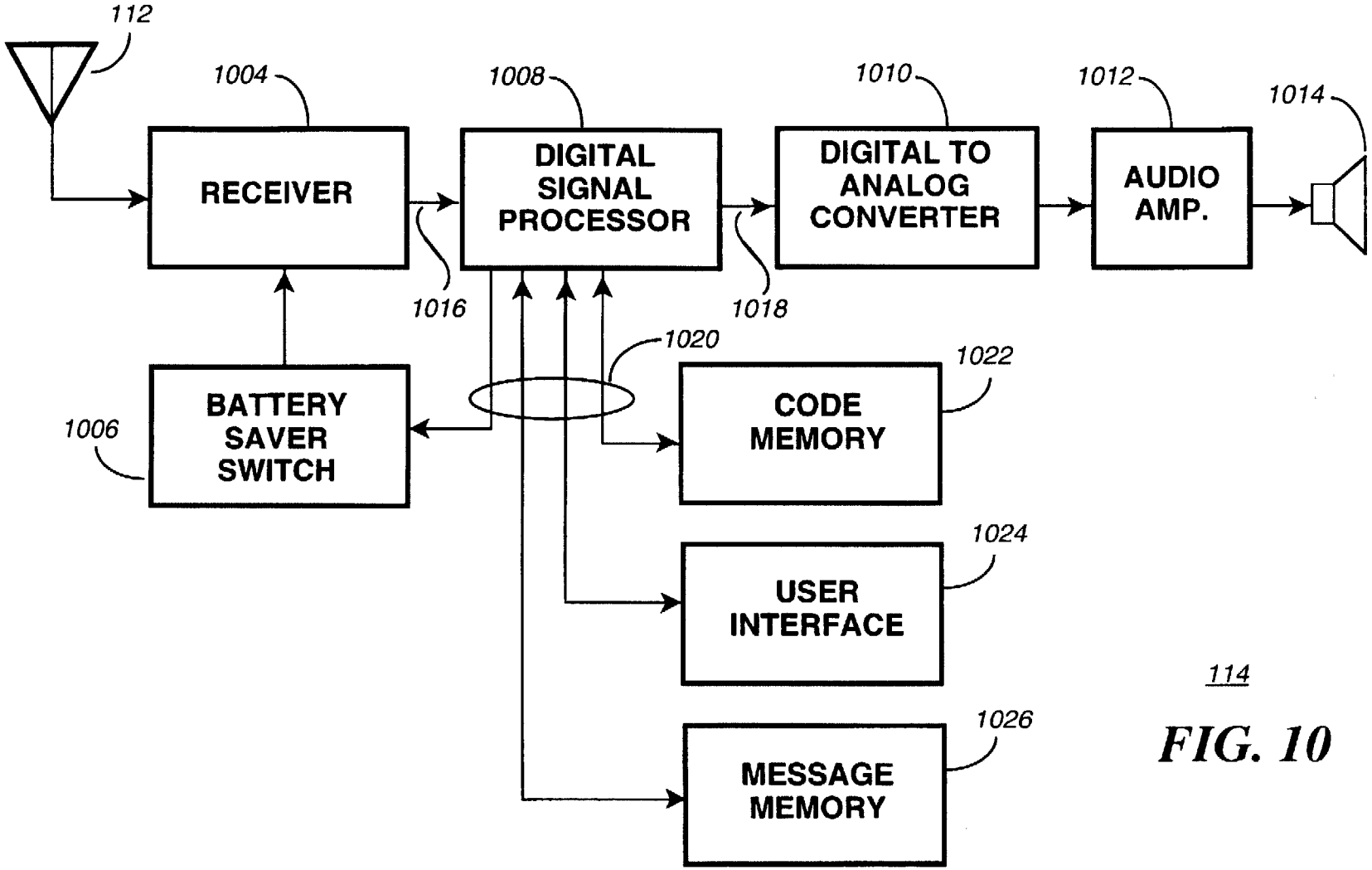
FIG. 10 is a electrical block diagram of a paging receiver utilizing the digital voice compression process in accordance with the present invention.

FIG. 10 is an electrical block diagram of the communications device 114 such as a paging receiver. The signal transmitted from the transmitting antenna 110 is intercepted by the receiving antenna 112. The receiving antenna 112 is coupled to a receiver 1004. The receiver 1004 processes the signal received by the receiving antenna 112 and produces a receiver output signal 1016 which is a replica of the encoded data transmitted. The encoded data is encoded in a predetermined signaling protocol, such as a POCSAG protocol. A digital signal processor 1008 processes the receiver output signal 1016 and produces a decompressed digital speech data 1018 as will be described below. A digital to analog converter converts the decompressed digital speech data 1018 to an analog signal that is amplified by the audio amplifier 1012 and annunciated by speaker 1014.

Figure 11:
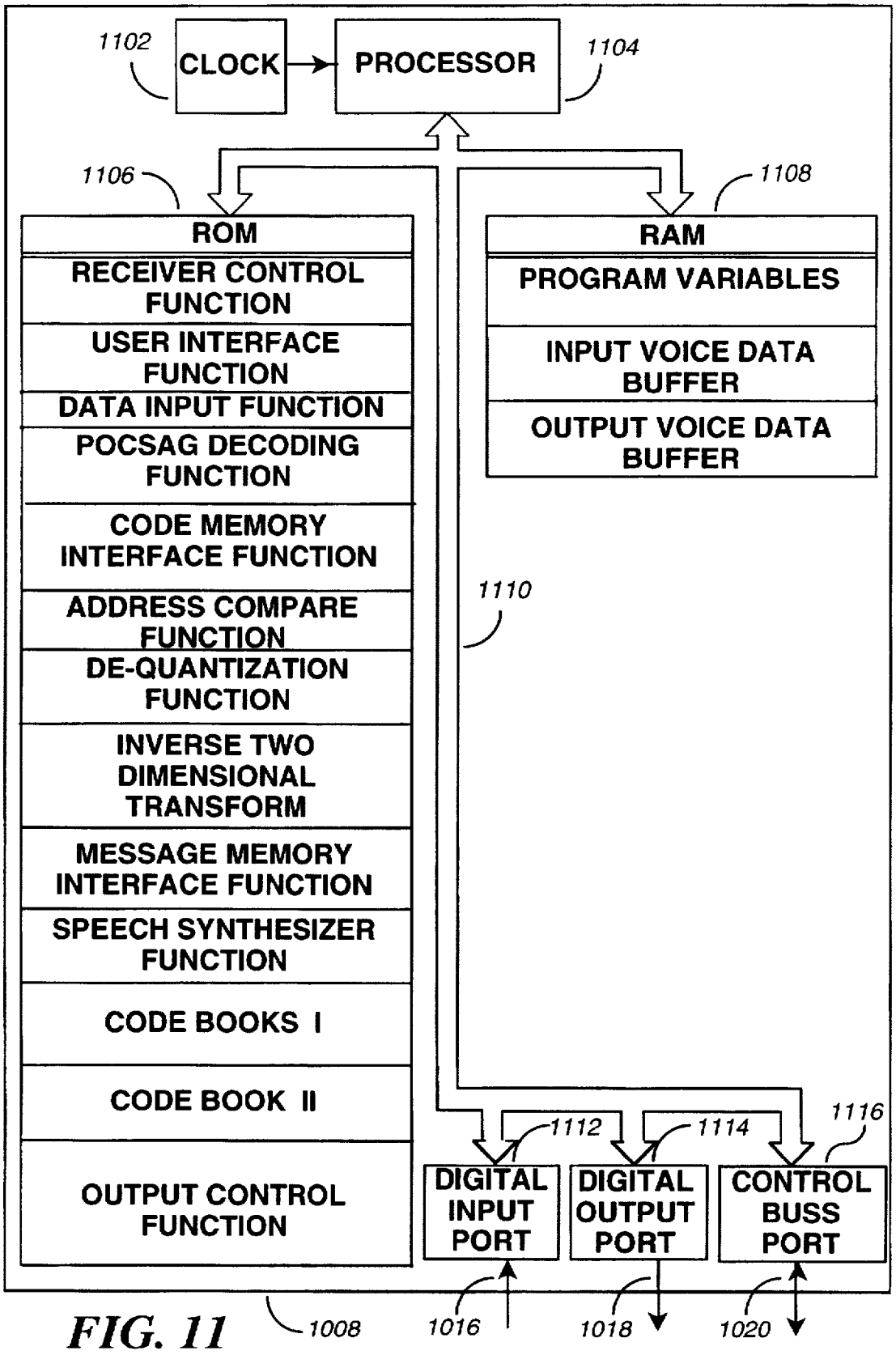
FIG. 11 is a electrical block diagram of the digital signal processor used in the paging receiver of FIG. 10.

The digital signal processor 1008 also provides the basic control of the various functions of the communications device 114. The digital signal processor 1008 is coupled to a battery saver switch 1006, a code memory 1022, a user interface 1024, and a message memory 1026, via the control buss 1020. The code memory 1022 stores unique identification information or address information, necessary for the controller to implement the selective call feature. The user interface 1024 provides the user with an audio, visual or mechanical signal indicating the reception of a message and can also include a display and push buttons for the user to input commands to control the receiver. The message memory 1026 provides a place to store messages for future review, or to allow the user to repeat the message. The battery saver switch 1006 provide a means of selectively disabling the supply of power to the receiver during a period when the system is communicating with other pagers or not transmitting, thereby reducing power consumption and extending battery life in a manner well known to one ordinarily skilled in the art. FIG. 11 shows an electrical block diagram of the digital signal processor 1008 used in the communications device 114. The processor 1104 is similar to the processor 804 shown in FIG. 8. However because the quantity of computation performed when decompressing the digital voice message is much less then the amount of computation performed during the compression process, and the power consumption is critical in portable paging receiver, the processor 1104 can be a slower, lower power version. The processor 1104 is coupled to a ROM 1106, a RAM 1108, a digital input port 1112, a digital output port 1114, and a control buss port 1116, via the processor address and data buss 1110. The ROM 1106 stores the instructions used by the processor 1104 to perform the signal processing function required to decompress the message and to interface with the control buss port 1116. The ROM 1106 contains the instruction to perform the functions associated with compressed voice messaging. The RAM 1108 provides temporary storage of data and program variables. The digital input port 1112 provides the interface between the processor 1104 and the receiver 1004 under control of the data input function. The digital output port 1114 provides the interface between the processor 1104 and the digital to analog converter under control of the output control function. The control buss port 1116 provides an interface between the processor 1104 and the control buss 1020. A clock 1102 generates a timing signal for the processor 1104.

The ROM 1106 contains by way of example the following: a receiver control function routine, a user interface function routine, a data input function routine, a POCSAG decoding function routine, a code memory interface function routine, an address compare function routine, a de-quantization function routine, an inverse two dimensional transform function routine, a message memory interface function routine, a speech synthesizer function routine, an output control function routine and one or more code books as described above.

Figure 12:
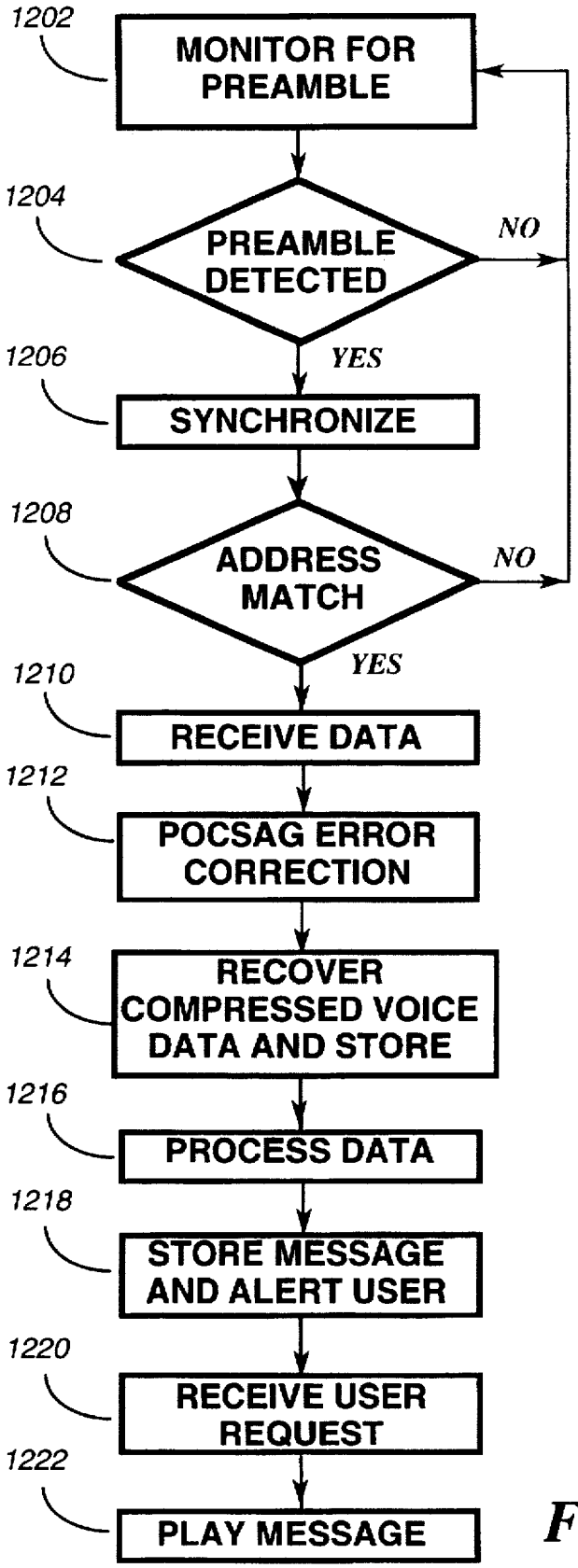
FIG. 12 is a flow chart showing the operation of the paging receiver of FIG. 10.

FIG. 12 is a flow chart which describes the operation of the communications device 114. In step 1202, the digital signal processor 1008 sends a command to the battery saver switch 1006 to supply power to the receiver 1004. The digital signal processor 1008 monitors the receiver output signal 1016 for a bit pattern indicating that the paging terminal is transmitting a signal modulated with a POCSAG preamble.

In step 1204, a decision is made as to the presence of the POCSAG preamble. When no preamble is detected, then the digital signal processor 1008 sends a command to the battery saver switch 1006 inhibits the supply of power to the receiver for a predetermined length of time. After the predetermined length of time, at step 1202, monitoring for preamble is again repeated as is well known in the art. In step 1206, when a POCSAG preamble is detected the digital signal processor 1008 will synchronize with the receiver output signal 1016.

When synchronization is achieved, the digital signal processor 1008 may issue a command to the battery saver switch 1006 to disable the supply of power to the receiver until the frame assigned to the communications device 114 is expected. At the assigned frame, the digital signal processor 1008 sends a command to the battery saver switch 1006, to supply power to the receiver 1004. In step 1208, the digital signal processor 1008 monitors the receiver output signal 1016 for an address that matches the address assigned to the communications device 114. When no match is found the digital signal processor 1008 send a command to the battery saver switch 1006 to inhibit the supply of power to the receiver until the next transmission of a synchronization code word or the next assigned frame, after which step 1202 is repeated. When an address match is found then in step 1210, power is maintained to the receive and the data is received.

In step 1212, error correction can be performed on the data received in step 1210 to improve the quality of the voice reproduced. The nine parity bits shown in the POCSAG frame 900 are used in the error correction process. POCSAG error correction techniques are well known to one ordinarily skilled in the art. The corrected data is stored in step 1214. The stored data is processed in step 1216. The processing of digital voice data is a decompression process to be described below.

In step 1218, the digital signal processor 1008 stores the decompressed voice data, received as one or more indexes in the message memory 1026 and send a command to the user interface to alert the user. In step 1220, the user enters a command to play out the message. In step 1222, the digital signal processor 1008 responds by passing the decompressed voice data that is stored in message memory to the digital to analog converter 1010. The digital to analog converter 1010 converts the decompressed digital speech data 1018 to an analog signal that is amplified by the audio amplifier 1012 and annunciated by speaker 1014.

Figure 13:
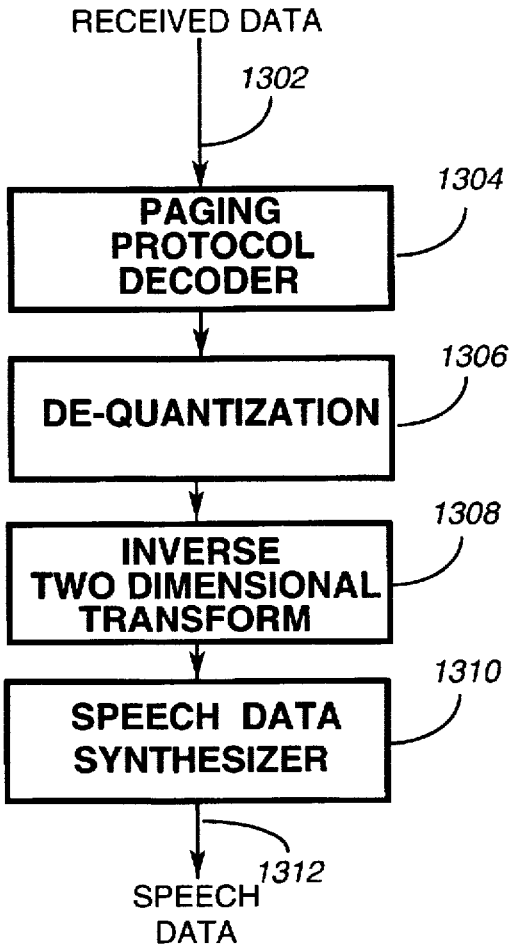
FIG. 13 is a flow chart showing the digital voice data decompression procedure utilized in the paging receiver of FIG. 10.

FIG. 13 is a flow chart showing an overview of the digital voice decompression process. In step 1304, paging protocol decoder, receives data encoded with the series of indexes corresponding to one or more templates of a set of predetermined templates, which represent the digital speech message. The indexes are extracted from the POCSAG encoded data 1302 received, and then stored. In step 1306, the stored indexes are used to find the corresponding template in a code book stored in the digital signal processor 1008 ROM.

In step 1308, an inverse two dimensional transform is performed on the template in the code book pointed at by the indexed index extracted from the POCSAG encoded data received using a predetermined inverse matrix transformation function. The inverse two dimensional transform generates an array of LPC speech parameters representing the original speech parameters. The predetermined inverse two dimensional transform process utilized is preferably a inverse two dimensional discrete cosine transform process, although it will be appreciated that other transforms that can be used to produce array of LPC speech parameters as well.

In step 1310, the LPC parameters are used to generate the speech data 1312. The recovered message data is stored in RAM 1108 for digital to analog conversion and annunciated upon request of the user.

Figure 14:
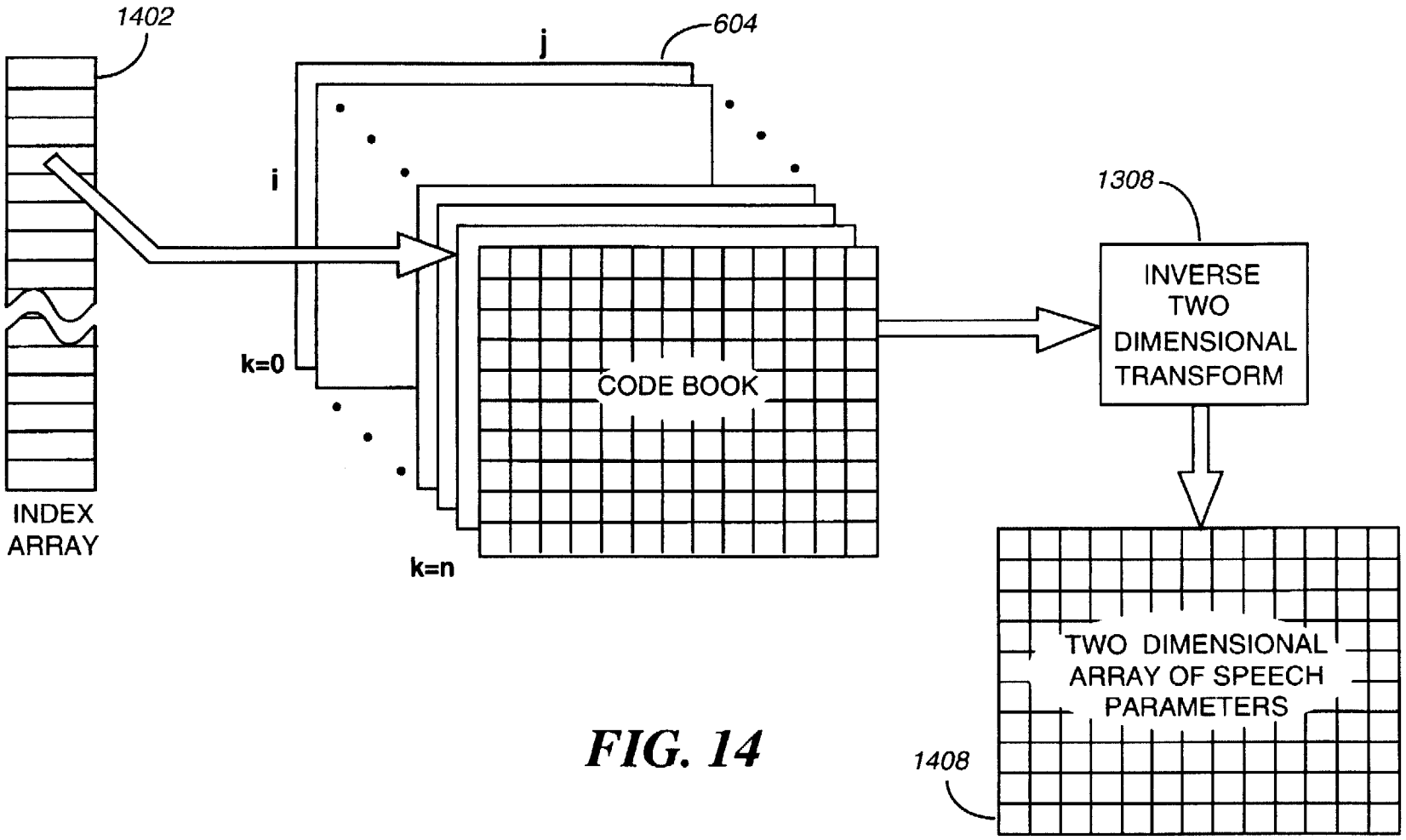
FIG. 14 is a diagram illustrating details of the digital voice decompression process utilized in the digital signal processor of FIG. 11.

FIG. 14 is a diagram illustrating the step of the voice decompressed process shown in FIG. 13. The indexes received and stored in step 1304 are stored in a index array 1402. Each index in index array 1402 points at a page in code book 604. The code book 604 is comprised of a duplicate set of predetermined templates that duplicate the templates that were used in the compression process. The indexes stored in the index array 1402 are selected one at a time in the order in which they were received. A inverse two dimensional transform 1308 is performed, using a predetermined inverse matrix function, on each page in the code book that is pointed at by the selected index. The inverse two dimensional transform 1308 produces a two dimensional array of speech parameters 1408. The parameters are LPC speech parameters and are used by the speech data synthesizer in step 1310 to generates speech data 1312. The predetermined inverse matrix function is preferably a inverse two dimensional discrete cosine function.

One or more code books corresponding to one or more predetermined languages can be stored in the ROM 1106. The appropriate code book will be selected by the digital signal processor 1008 based on the identifier encoded with the received data in the receiver output signal 1016.

Figure 15:
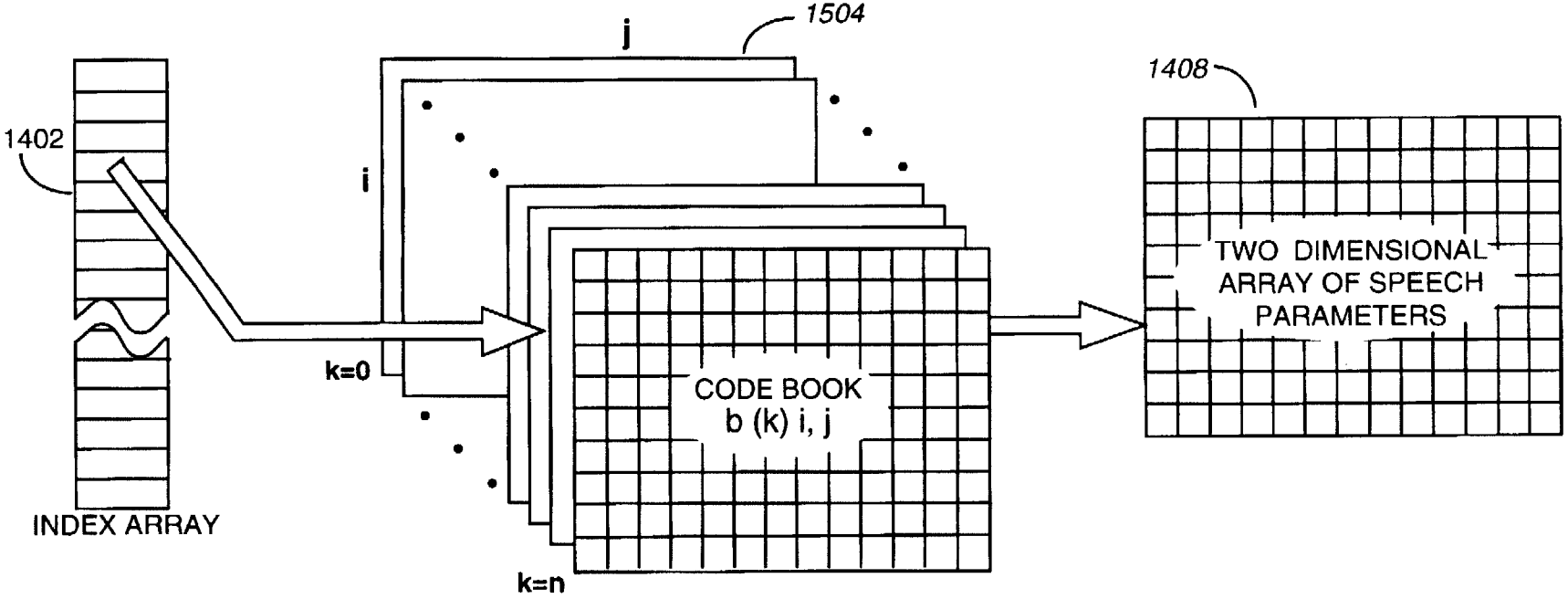
FIG. 15 is a diagram illustrating details of an alternate digital voice de-compression process utilized a pre-processed code book.

In an alternate embodiment of the present invention shown in FIG. 15, the digital signal processing required in the receiving process is reduced by pre-processing the templates stored in the code book 604. The templates in the code book 604 are essentially the same size as the arrays of LPC parameters that result from the inverse two dimensional transform being performed on the templates. Since the resulting arrays of LPC parameter are essentially the same size as the original templates, the code book 604 containing templates is replaced with a code book 1504 containing the arrays of LPC parameter. In so doing the inverse two dimensional transform is performed only once during development and does not have to be repeated while processing each voice message segment. The two dimensional array of speech parameters 1408 is produced by simply copying a page of the code book 1504.

Figure 16:
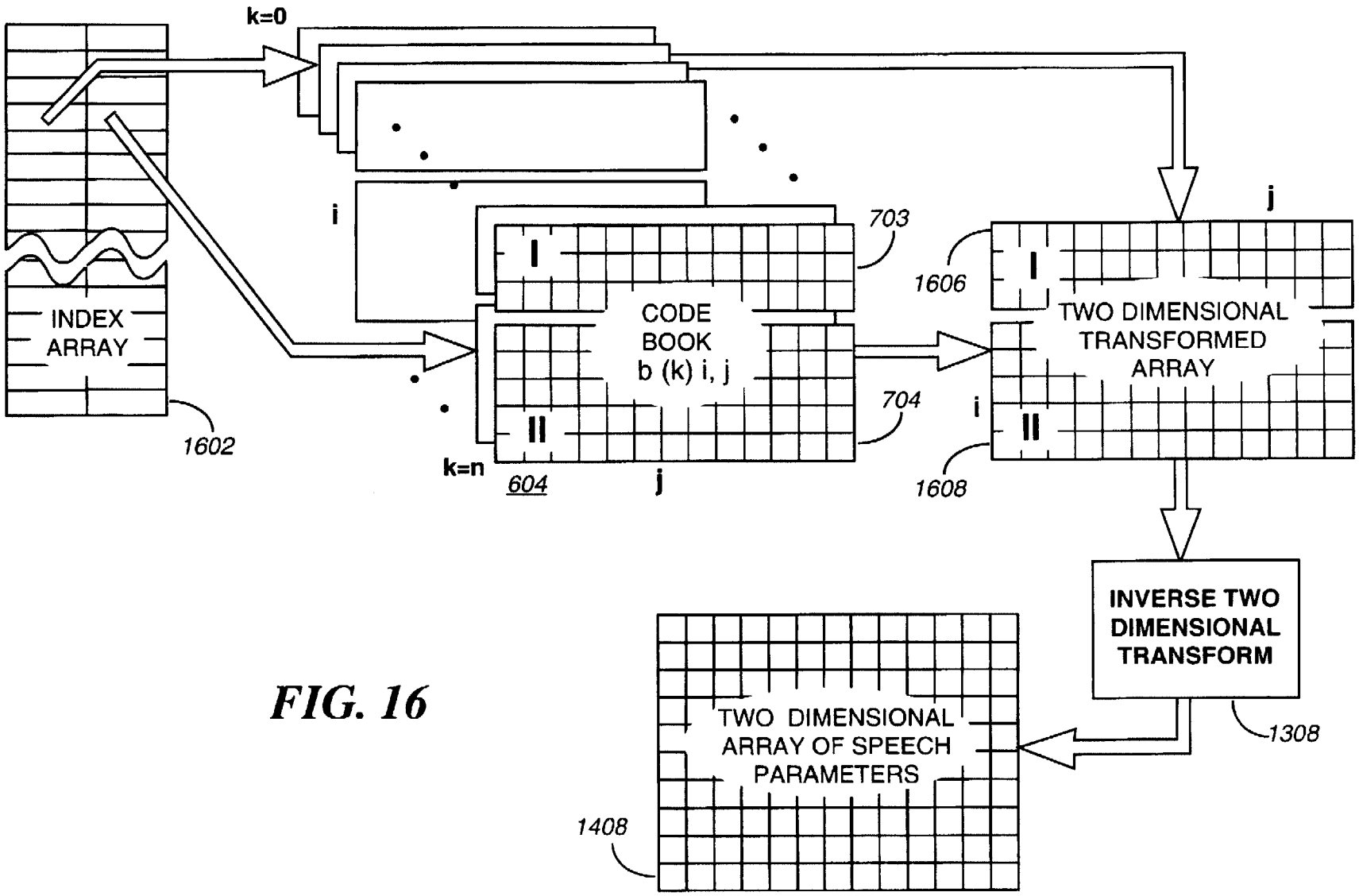
FIG. 16 is a diagram illustrating details of an alternate digital voice de-compression process utilized a segmented code book.

FIG. 16 is a diagram illustrating the step of the segmented voice decompressed process associated with the alternate embodiment illustration FIG. 7. The index array 1602 has two indexes stored for each segmented page. The first index selects a template of template set I 703 corresponding to the first segment compressed during the compression process. The second index selects a template of template set II 704 corresponding to the second segment compressed during the compression process. The segment I represented by a template of template set I 703 from the first selected page is combined with the segment II represented by a template of template set II 704 from the second selected page to form a two dimensional transformed array comprised of segment I 1609 and segment II 1608. The inverse two dimensional transform 1306 is performed producing the two dimensional array of speech parameters 1408.

As hitherto stated, the present invention digitally encodes the voice messages in such a way that the resulting data is very highly compressed and can easily be mixed with the normal data sent over the paging channel or other similar communications channel. In addition the voice message is digitally encoded in such a way, that processing in the pager or similar portable device is minimized. While specific embodiment of this invention have been shown and described, it will be appreciated that further modification and improvement will occur to those skilled in the art.

We claim:

1. A method for processing a voice message to provide low bit rate speech transmission, said method comprising the steps of:

processing the voice message for generating speech parameters;

arranging the speech parameters into a two dimensional parameter matrix comprising a sequence of parameter frames;

transforming the two dimensional parameter matrix using a predetermined two dimensional matrix transformation function to obtain a two dimensional transform matrix;

deriving a set of distance values representing distances between templates of a set of predetermined templates and the two dimensional transform matrix, the set of distance values which are derived being identified by indexes identifying the templates of the set of predetermined templates;

comparing the set of distance values derived and selecting therefrom an index corresponding to a template of the set of predetermined templates having a shortest distance of the set of distance values derived; and transmitting the index corresponding to the template of the set of predetermined templates having the shortest distance selected.

2. The method according to claim 1, wherein the voice message is an analog voice message, and wherein said step of processing the voice message comprises the steps of:

sampling the voice message for generating voice message samples; and digitizing the voice message samples for generating digitized speech samples.

3. The method according to claim 1, wherein the voice message is digitized into digitized speech samples, and wherein said step of processing the voice message comprises the steps of:

generating speech frames representing a predetermined number of digitized speech samples; and performing a speech analysis on the speech frames to derive the speech parameters.

4. The method according to claim 1, wherein the predetermined two dimensional matrix transformation function is a two dimensional discrete cosine transform function.

5. The method according to claim 1, further comprising a step of encoding the index corresponding to the shortest distance selected in a predetermined signaling protocol for transmission.

6. The method according to claim 1, wherein said step of processing further comprises a step of generating a two dimensional speech data matrix of speech parameters representing the voice message, and wherein the sequence of parameter frames comprises a portion of the two dimensional speech data matrix.

7. The method according to claim 6, wherein the portion of the two dimensional speech data matrix comprises a predetermined number of parameter frames corresponding to the two dimensional parameter matrix.

8. The method according to claim 6, wherein the portion of the two dimensional speech data matrix comprises a variable number of parameter frames corresponding to the two dimensional parameter matrix.

9. The method according to claim 6, wherein said method further comprises a step of storing a sequence of indexes in an index array, wherein an index corresponds to a template having the shortest distance which best represents the portion of the two dimensional speech data matrix.

10. The method according to claim 9, further comprising a step of encoding the index array in a predetermined signaling protocol for transmission.

11. The method according to claim 1 wherein said step of deriving comprises the step of calculating a distance value using $$d_k = \sum_{i,j} w_{i,j}(a_{i,j} - b(k)_{i,j})^2$$

where $d_k$ represents a distance for a template of the set of predetermined templates and the two dimensional transform matrix, $(a_{i,j} - b(k)_{i,j})$ represents a difference between corresponding cells of each template of the set of predetermined templates and the two dimensional transform matrix, and $w_{i,j}$ represents a corresponding cell of a predetermined weighting array.

12. The method according to claim 1, wherein the set of predetermined templates comprises a first set of predetermined templates and at least a second set of predetermined templates, and wherein said step of deriving a distance value derives a first distance value representing a distance between each template of the first set of predetermined templates and a first portion of the two dimensional transform matrix, the first distance value identified by a first index corresponding to each template of the first set of predetermined templates, and further derives at least a second distance value representing a distance between each template of the at least a second set of predetermined templates and at least a second portion of the two dimensional transform matrix, the at least a second distance value identified by at least a second index corresponding to each template of the at least a second set of predetermined templates, and wherein said step of deriving a set of distance values derives a first set of first distance values for the first set of predetermined templates, and further derives at least a second set of at least second distance values for the at least a second set of predetermined templates, and wherein said step of comparing compares the first set of first distance values derived and selecting therefrom a first distance value having a shortest distance for the first set of at least first distance values, and further compares the at least a second set of at least second distance values derived and selecting therefrom at least a second distance value having a shortest distance for an at least first set of at least second distance values, and said step of transmitting transmits the first index corresponding to the first distance value selected, and further transmits an at least second index corresponding to the at least a second distance value selected.

13. The method according to claim 1, wherein a second set of predetermined templates comprises fewer templates than the first set of predetermined templates.

14. The method according to claim 1, wherein the set of predetermined templates represents a code book, and wherein said method further comprises the steps of:

analyzing the speech parameters generated to determine a characteristic of the voice message;

selecting a predetermined code book of a set of code books corresponding to the characteristic of the voice message determined; and further transmitting a code book identifier identifying the predetermined code book selected.

15. The method according to claim 14, further comprising the step of encoding the index and the code book identifier identifying the predetermined code book selected in a predetermined signaling protocol for transmission.

16. The method according to claim 1, wherein a set of predetermined templates represents a code book, and wherein said method further comprises the steps of:

receiving the voice message in a predetermined language and further receiving information identifying the predetermined language;

selecting a predetermined code book corresponding to the predetermined language from a set of predetermined code books corresponding to a set of predetermined languages; and further transmitting a code book identifier identifying the predetermined code book selected.

17. The method according to claim 16, wherein the voice message is delivered via a telephone network and wherein a telephone access number provides the information identifying the predetermined language.

18. The method according to claim 16, wherein the voice message is delivered via a telephone network and wherein a user provides the information identifying the predetermined language.

19. The method according to claim 18, wherein the user provides the information identifying the predetermined language by entering a predetermined code.

20. A method for processing a low bit rate speech transmission to provide a voice message, said method comprising the steps of:

receiving one or more indexes corresponding to one or more templates of a set of predetermined templates;

generating an array of speech parameters from the one or more templates corresponding to the one or more indexes received;

processing the array of speech parameters for generating decompressed digital speech data; and generating a voice message from the decompressed digital speech data.

21. The method according to claim 20 further comprising a step of storing the set of predetermined templates.

22. The method according to claim 21, wherein the set of predetermined templates which is stored corresponds to a duplicate set of predetermined templates utilized to compress the voice message.

23. The method according to claim 21, wherein the set of predetermined templates which is stored corresponds to a duplicate set of predetermined templates utilized to compress the voice message which have been transformed using a predetermined inverse matrix transformation function prior to being stored.

24. The method according to claim 23, wherein the predetermined inverse matrix transformation function is a inverse two dimensional discrete cosine function.

25. The method according to claim 21, wherein set of predetermined templates stored represents a code book which corresponds to a predetermined language, and wherein one or more code books corresponding to one or more predetermined languages are stored.

26. The method according to claim 25, wherein said step of storing further stores code book identifiers identifying the one or more code books which are stored.

27. The method according to claim 26, wherein the code book identifiers identifying the one or more code books which are stored correspond to information provided by a user.

28. The method according to claim 27, wherein the information provided by the user corresponds to telephone access numbers.

29. The method according to claim 26, wherein the one or more indexes and code book identifiers identifying a predetermined code book are received encoded in a predetermined signaling protocol.

30. The method according to claim 29, wherein the array of speech parameters is arranged into speech parameter frames for compression, and wherein the speech parameter frames are received encoded in the predetermined signaling protocol.

31. The method according to claim 20, wherein said step of generating the array of speech parameters comprises a step of transforming the one or more templates using a predetermined inverse matrix transformation function.

32. An asymmetric voice compression processor for processing a voice message to provide low bit rate speech transmission, said asymmetric voice compression processor comprising:

an input speech processor for processing the voice message for generating digitized speech data;

a signal processor programmed to generate speech parameters from the digitized speech data;

arrange the speech parameters into a two dimensional parameter matrix comprising a sequence of parameter frames;

transform the two dimensional parameter matrix using a predetermined two dimensional matrix transformation function to obtain a two dimensional transform matrix;

derive distance values representing distances between templates of a set of predetermined templates and the two dimensional transform matrix, the distance values derived being identified by indexes corresponding to the templates of the set of predetermined templates;

compare the distance values derived and to select therefrom an index corresponding to a template of the set of predetermined templates having a shortest distance of the distance values derived; and a transmitter for transmitting the index corresponding to the template of the set of predetermined templates having the shortest distance selected.

33. The asymmetric voice compression processor according to claim 32, wherein the voice message is an analog voice message, and wherein said input speech processor comprises:

a sampler for sampling the voice message for generating voice message samples; and a digitizer for digitizing the voice message samples for generating digitized speech data.

34. The asymmetric voice compression processor according to claim 32, wherein the voice message is digitized into digitized speech samples, and wherein said input speech processor comprises:

a framer for generating speech frames representing a predetermined number digitized speech samples; and a speech analyzer for performing a speech analysis on the speech frames to generate the speech parameters.

35. The asymmetric voice compression processor according to claim 32, wherein the predetermined two dimensional matrix transformation function is a two dimensional discrete cosine function.

36. The asymmetric voice compression processor according to claim 32, further comprising an encoder for encoding the index corresponding to the shortest distance selected in a predetermined signaling protocol for transmission.

37. The asymmetric voice compression processor according to claim 32, wherein said signal processor is further programmed to generate a two dimensional speech data matrix of speech parameters representing the voice message, and wherein the sequence of parameter frames comprises a portion of the two dimensional speech data matrix.

38. The asymmetric voice compression processor according to claim 37, wherein the portion of the two dimensional speech data matrix comprises a predetermined number of parameter frames corresponding to the two dimensional parameter matrix.

39. The asymmetric voice compression processor according to claim 37, wherein the portion of the two dimensional speech data matrix comprises a variable number of parameter frames corresponding to the two dimensional parameter matrix.

40. The asymmetric voice compression processor according to claim 37, said signal processor further comprises a memory for storing a sequence of indexes in an index array.

wherein an index corresponds to a template having shortest distance best representing the portion of the two dimensional speech data matrix.

41. The asymmetric voice compression processor according to claim 40, further comprising an encoder for encoding the index array in a predetermined signaling protocol for transmission.

42. The asymmetric voice compression processor according to claim 32 wherein said signal processor derives a distance value by calculating the distance value using $$d_k = \sum_{i,j} w_{i,j}(a_{i,j} - b(k)_{i,j})^2$$

where $d_k$ represents a distance for a template of the set of predetermined templates and the two dimensional transform matrix, $(a_{i,j} - b(k)_{i,j})$ represents a difference between corresponding cells of each template of the set of predetermined templates and the two dimensional transform matrix, and $w_{i,j}$ represents a corresponding cell of a predetermined weighting array.

43. The asymmetric voice compression processor according to claim 32, wherein the set of predetermined templates comprises a first set of predetermined templates and at least a second set of predetermined templates, and wherein said signal processor derives a first distance value representing a distance between each template of the first set of predetermined templates and a first portion of the two dimensional transform matrix, the first distance value identified by a first index corresponding to each template of the first set of predetermined templates, and wherein said signal processor is further programmed to derive at least a second distance value representing a distance between each template of the at least a second set of predetermined templates and at least a second portion of the two dimensional transform matrix, the at least a second distance value identified by at least a second index corresponding to each template of the at least a second set of predetermined templates, and wherein said signal processor derives a set of distance values by deriving a first set of first distance values for the first set of predetermined templates, and further deriving at least a second set of at least second distance values for the at least a second set of predetermined templates, and wherein said signal processor compares the first set of first distance values derived and selecting therefrom a first distance value having a shortest distance for the first set of at least first distance values, and further compares the at least a second set of at least second distance values derived and selecting therefrom at least a second distance value having a shortest distance for an at least first set of at least second distance values, and said transmitter transmits the first index corresponding to the first distance value selected, and further transmits an at least second index corresponding to the at least a second distance value selected.

44. The asymmetric voice compression processor according to claim 32, wherein a second set of predetermined templates comprises fewer templates than the first set of predetermined templates.

45. The asymmetric voice compression processor according to claim 32, wherein the set of predetermined templates represents a code book, and wherein said signal processor is further programmed to analyze the speech parameters generated to determine a characteristic of the voice message, select a predetermined code book of a set of code books corresponding to the characteristic of the voice message determined, and said transmitter further transmits a code book identifier identifying the predetermined code book selected.

46. The asymmetric voice compression processor according to claim 45, wherein said signal processor further comprises an encoder for encoding the index and the code book identifier identifying the predetermined code book selected in a predetermined signaling protocol for transmission.

47. The asymmetric voice compression processor according to claim 32, wherein a set of predetermined templates represents a code book, and wherein said input speech processor receives the voice message in a predetermined language and further for receiving information identifying the predetermined language, said signal processor selects a predetermined code book corresponding to the predetermined language from a set of predetermined code books corresponding to a set of predetermined languages, and said transmitter transmits a code book identifier identifying the predetermined code book selected.

48. The asymmetric voice compression processor according to claim 47, wherein the voice message is delivered via a telephone network and wherein a telephone access number provides the information identifying the predetermined language.

49. The asymmetric voice compression processor according to claim 47, wherein the voice message is delivered via a telephone network and wherein a user provides the information identifying the predetermined language.

50. The asymmetric voice compression processor according to claim 49, wherein the user provides the information identifying the predetermined language by entering a predetermined code.

51. A communication device for receiving a low bit rate speech transmission to provide a voice message, said communication device comprising:

a receiver for receiving one or more indexes corresponding to one or more templates of a set of predetermined templates;

a signal processor programmed to generate an array of speech parameters from the one or more templates corresponding to the one or more indexes received;

a speech synthesizer for processing the array of speech parameters for generating decompressed digital speech data; and a converter for generating a voice message from the decompressed digital speech data.

52. The communication device according to claim 51 further comprising a memory for storing the set of predetermined templates.

53. The communication device according to claim 52, wherein the set of predetermined templates stored in said memory corresponds to a duplicate set of predetermined templates utilized to compress the voice message.

54. The communication device according to claim 52, wherein the set of predetermined templates stored in said memory corresponds to a duplicate set of predetermined templates utilized to compress the voice message which have been transformed using a predetermined inverse matrix transformation function prior to being stored in said memory.

55. The communication device according to claim 54, wherein the predetermined inverse matrix transformation function is a inverse two dimensional discrete cosine function.

56. The communication device according to claim 52, wherein the set of predetermined templates stored in said memory represents a code book which corresponds to a predetermined language, and wherein said memory stores one or more code books corresponding to one or more predetermined languages.

57. The communication device according to claim 56, wherein said memory further stores code book identifiers for identifying the one or more code books stored in said memory.

58. The communication device according to claim 57, wherein the code book identifiers identifying the one or more code books stored in said memory correspond to information provided by a user.

59. The communication device according to claim 58, wherein the information provided by the user corresponds to telephone access numbers.

60. The communication device according to claim 57, wherein the one or more indexes and code book identifiers identifying a predetermined code book are encoded in a predetermined signaling protocol for transmission, and wherein said communication device further comprises a decoder for decoding the one or more indexes corresponding to one or more templates of the set of predetermined templates and the code books identifiers identifying a predetermined code book from within the predetermined signaling protocol utilized for transmission.

61. The communication device according to claim 51, wherein said signal processor is programmed to generate the array of speech parameters by transforming the one or more templates using a predetermined inverse matrix transformation function.

* * * * *